US007254906B2

(12) United States Patent
Morris et al.

(10) Patent No.: US 7,254,906 B2
(45) Date of Patent: Aug. 14, 2007

(54) FOOT CUSHIONING CONSTRUCT AND SYSTEM FOR USE IN AN ARTICLE OF FOOTWEAR

(76) Inventors: Kwame Morris, 270 Buckminster Rd., Brookline, MA (US) 02445; Martin Salem, 93 Edward Kelleher Dr., Stoughton, MA (US) 02072

( * ) Notice: Subject to any disclaimer, the term of this patent is extended or adjusted under 35 U.S.C. 154(b) by 0 days.

(21) Appl. No.: 10/373,133

(22) Filed: Feb. 24, 2003

(65) Prior Publication Data

US 2004/0163280 A1 Aug. 26, 2004

(51) Int. Cl.
*A43B 13/18* (2006.01)
*A43B 13/20* (2006.01)

(52) U.S. Cl. ..... 36/28; 36/29; 36/35 B; 36/27

(58) Field of Classification Search ..... 36/29, 36/3 B, 30 R, 3 R, 27, 28, 31, 35 B, 43
See application file for complete search history.

(56) References Cited

U.S. PATENT DOCUMENTS 3,834,046 A * 9/1974 Fowler ..... 36/28
4,451,994 A * 6/1984 Fowler ..... 36/28
5,402,588 A * 4/1995 Graham et al. ..... 36/28
5,595,002 A * 1/1997 Slepian et al. ..... 36/27
5,729,917 A * 3/1998 Slepian et al. ..... 36/27
5,852,886 A * 12/1998 Slepian et al. ..... 36/27
5,860,226 A * 1/1999 Graham et al. ..... 36/28
5,974,695 A * 11/1999 Slepian et al. ..... 36/27
6,446,359 B2 * 9/2002 Tomat ..... 36/28

FOREIGN PATENT DOCUMENTS

GB 2243530 * 11/1991
WO WO 8705784 * 10/1987
WO WO 9000021 * 1/1990
WO WO 9203069 * 3/1992
WO WO 9303639 * 3/1993
WO WO 9421150 * 9/1994

* cited by examiner

*Primary Examiner*—Ted Kavanaugh
(74) *Attorney, Agent, or Firm*—Cantor Colburn LLP

(57) ABSTRACT

The present invention provides an unique improvement in foot cushioning constructs and shock absorbing systems for a constructed article of footwear to be worn by a person. The invention employs a deformable and re-formable elastic stretchsole joined as a planar sheet to the perimeter edge of the shoe upper and forms an elastic end closure for the shoe upper; and includes not less than one pre-positioned median cavity able to receive at least a part of the deformed elastic stretchsole layer and cushion the compression forces generated thereon by a person's foot. The foot cushioning construct and system provides a trampoline effect that will lessen the impact on the foot and create greater comfort for the wearer of the shoe.

32 Claims, 20 Drawing Sheets

A'
A
B'
B
20
40
50
60

6
22
10
50
80
60
48
30
40

8
22
30
40
60
80
10
48

L
M
2
20
300
60
M
L 330
340
48
G
22
50
40
60

40
48
8
22
330
340
60
50

FOOT CUSHIONING CONSTRUCT AND SYSTEM FOR USE IN AN ARTICLE OF FOOTWEAR

FIELD OF THE INVENTION

The present invention is concerned with articles of footwear such as athletic and walking shoes; and is particularly directed to means for foot cushioning and shock absorption to control the compression forces generated by a person when standing, walking, or running.

BACKGROUND OF THE INVENTION

A conventional shoe made today typically has three major components, as follows.

(1) The upper: This component entity is an assembly which holds and conforms to the shape of the person's foot. The traditional purpose of the shoe upper is to fit the foot properly, comfortably, and snuggly. Ideally, this upper portion of the shoe will also be aesthetically pleasing, be comfortable, and be highly durable.

(2) The Outsole: This component entity is the lower exterior and bottom component of the shoe; and is typically joined to the exterior surface of the shoe upper directly using adhesives or other bonding techniques. The outsole typically is constructed of a durable material or combination of different materials such as rubber or rubber derivatives, and whose purpose is to provide both traction and exterior protection for the wearer's foot.

(3) The insole: This component entity, sometimes referred to as a "sock liner", is a layer of material inserted into the interior of the upper shoe assembly; is visible to the naked eye when viewing the interior of the footwear; and typically is the exposed surface and material layer upon which the person's foot is physically placed. The purpose and function of the insole is to provide an additional layer of shock absorbing material directly under the foot within the upper and/or to provide some arch support for the foot while wearing the shoe.

In addition, certain shoes, such as athletic shoes, are considered to contain a "midsole." Although technically a modified portion of the outsole, this portion is commonly considered as though it were a separate component located above the outsole and below the upper of the shoe. The midsole is normally constructed from such materials as ethylene vinyl acetate (EVA) and polyurethane (PU). Its primary function is to create a resilient and shock-absorbing layer to the footwear.

Shoes are typically constructed on a "last," which is a solid form, usually made of plastic, over which the shoe upper is made. It is the last that determines the size, shape and certain style features of the shoe. The last is removed from the finished shoe prior to packing and then is re-used repeatedly in the construction of another shoe as part of the manufacturing process.

Within the footwear industry, it has long been recognized that a primary purpose and function of a shoe is to protect and support the human foot while the person performs his normal activities. Also, the increasing popularity of athletic sports, be it on a competitive or exercise level, has been accompanied by an ever-increasing number of new shoe designs and constructions that are intended to meet the needs of the individual when performing in the these events. Thus, a shoe such as an athletic shoe typically includes an outer sole to provide traction and foot protection; a midsole to provide cushioning; a shoe upper that is stitched or glued to the periphery of the outer sole and an insole to provide additional cushioning and support. The upper is intended to hold the foot of the wearer to the substance of the outer sole in order to provide a tight and comfortable fit and to prevent any sliding of the foot within the shoe interior.

The recent increase in shoe designs and modes of construction has particular value for persons involved in athletic endeavors, as well as for those engaging merely in walking and running for health and exercise purposes. Typically, it is understood within the footwear industry that when a person walks or runs one foot is on the ground in a "stance mode" while the other foot is moving through the air in a "swing mode". Equally important, when in the stance mode, the person's foot recognizably moves through three successive movement phases when touching the ground. These movement phases are: the heel strike, the mid stance, and the toe off. Thus even in the stance mode, devices for cushioning should protect the human foot and shock absorption in order to control the compression forces generated by the person's foot upon the shoe.

The concept of providing cushioning and shock absorption for the foot is well known and often used, particularly within athletic footwear, to decrease the intense and repetitious impact which occurs during short time intervals in these activities. In addition, however, it is recognized also that foot cushioning systems can and often are beneficially incorporated into other types of footwear articles, including dress shoes, boots, sandals, as well as for athletic shoes, to provide better foot protection.

A wide variety of devices have been created in the footwear industry either to cushion the foot and/or to absorb the shock of the foot striking the ground. One early approach for impact absorption utilized blocks of compressible padding material; and many kinds of footwear have been constructed using cotton padding, horse hair padding, rubber, plastic foam, and the like as cushions. Within these designs, the inherent resilience of the compressible padding material is utilized to absorb and disperse the impact of the foot striking the ground. These compressible padding materials, however, present multiple problems. First, these materials are relatively inefficient in their ability to absorb shock and cushion the foot. Second, the materials typically become compacted after repeated use and often lose their cushioning properties. Third, with severe foot impact uses, these designs allow a full compression of the material and "bottom out" quickly, thereby transmitting the severe impact forces to the wearer's foot and body. In addition, when made thicker to avoid this third problem, these materials often become unstable, can become cumbersome and heavy, and typically interfere with the foot in performance of the exercise or physical routine.

More recently, manufacturers of athletic and running shoes have added other kinds of materials to cushion the person's foot when standing, walking, or running. Initially, foam of varying chemical composition was added to the shoe for cushioning and shock absorption purposes. Subsequently, shoe manufacturers developed other alternatives to foam-based cushioning systems because it was recognized that foam became permanently compressed with repeated use and thus ceased to perform the cushioning function. Other alternative designs for shock absorption and foot cushioning were also utilized with varying degrees of success. These included the use of compressed gas as the means to cushion the wearer's foot; the use of polyurethane elastomers as the cushioning material; a construction design having multiple layers of air cushioning; and the use of thermoplastic hollow tubes encapsulating a fluid or gas such as a freon.

Still other attempts to cushion the foot housed within a shoe are illustrated by the following: U.S. Pat. Nos. 5,070,629 and 5,561,920 describing an energy return system using a rigid frame construction and torsional rigidity bar in the mid foot area which provides cushioning and stability; U.S. Pat. No. 5,680,714 which describes the use of a plurality of elastic strips running at an angle across the shoe from one side to the other as a resilient return portion for shock absorption; U.S. Pat. No. 6,127,010 which discloses a shock absorbing cushioning device comprised of a compressible insert encapsulated within an elastomeric barrier member positioned within the outsole; and U.S. Pat. Nos. 6,195,915 and 6,330,757 which describe an outsole which is operative to store and release energy resulting from compression forces generated by the person's weight and is intended to be joined to standard footwear uppers.

The flaw in all of these conventionally available technologies and footwear designs is that each of these modifications concern themselves solely with the conventional outsole of the shoe to compress more efficiently; but none of these design modifications allow the upper of the shoe to assist in either a deceleration of the compression forces and shock upon the foot or in a cushioning the foot itself. Instead, all of the conventional footwear designs are structured and manufactured to hold the person's foot in a static position while the outsole, and possibly the midsole, of the shoe contorts to lessen the impact shock. Thus, the conventional footwear constructions are dedicated completely to materials and designs intended for compression within the outsole/midsole of the shoe; and none of the conventional footwear constructions allow the person's foot to either move or decelerate within the upper of the shoe in order to cushion the foot and to absorb the impact shock.

SUMMARY OF THE INVENTION

The present invention provides and presents multiple aspects.

A first aspect of the invention is, in a constructed article of footwear to be worn by a human person which includes at least a shoe upper having a perimeter edge for housing the human foot and an outsole joined to the shoe upper which serves as an exterior bottom for the article of footwear, the improvement in foot cushioning comprising:

an elastic stretchsole which is joined to the perimeter edge of and forms an elastic end closure for the shoe upper, said joined elastic stretchsole being able to deform and rebound repeatedly on-demand in response to the compression forces generated thereon by a person's foot, and at least one median cavity housed within the outsole of the footwear article and positioned adjacent to said joined elastic stretchsole of the shoe upper, said median cavity means presenting not less than one pre-positioned volume able to receive at least a part of a deformed elastic stretchsole and cushion the compression forces generated thereon by a person's foot.

A second aspect of the invention provides, in a constructed article of footwear to be worn by a person which includes at least a shoe upper having a perimeter edge for housing the human foot and an outsole portion joined to the shoe upper which serves as an exterior bottom for the article of footwear, the improvement in foot cushioning comprising:

an elastic stretchsole which is joined to the perimeter edge of and forms an elastic end closure for the upper shoe, said joined elastic stretchsole being able to deform and rebound repeatedly in response to the compression forces generated thereon by a person's foot; and at least one preformed cavity chamber of determinable dimensions and configuration housed within the outsole of the footwear article, said preformed cavity chamber being positioned adjacent to said joined elastic stretchsole of the shoe upper and presenting not less than one median cavity able to receive at least a part of a deformed elastic stretchsole and cushion the compression forces generated thereon by a person's foot.

A third aspect of the invention offers a foot cushioning system for use in a constructed article of footwear which includes a shoe upper having a perimeter edge for housing the human foot and an outsole which is joined to the shoe upper and serves as an exterior bottom for the article of footwear, said foot cushioning system comprising:

an elastic stretchsole configured as at least one planar sheet and joined as to the perimeter edge of the shoe upper as an end closure, said joined elastic stretchsole end closure deforming and then rebounding into planar layer form in response the compression forces generated thereon by a person's foot by; and at least one median cavity existing within a preformed cavity chamber which is housed within the outsole of the footwear article, wherein said median cavity and preformed cavity chamber lie adjacent to said joined stretchsole end closure of the shoe upper, and whereby said median cavity is able (i) to receive a deformed stretchsole end closure, and (ii) to cushion a person's foot from the effects of compression forces generated upon a deformed stretchsole end closure.

BRIEF DESCRIPTION OF THE FIGURES

The present invention can be more easily understood and better appreciated when taken in conjunction with the accompanying drawing, in which.

DETAILED DESCRIPTION OF THE INVENTION

Figure 1:
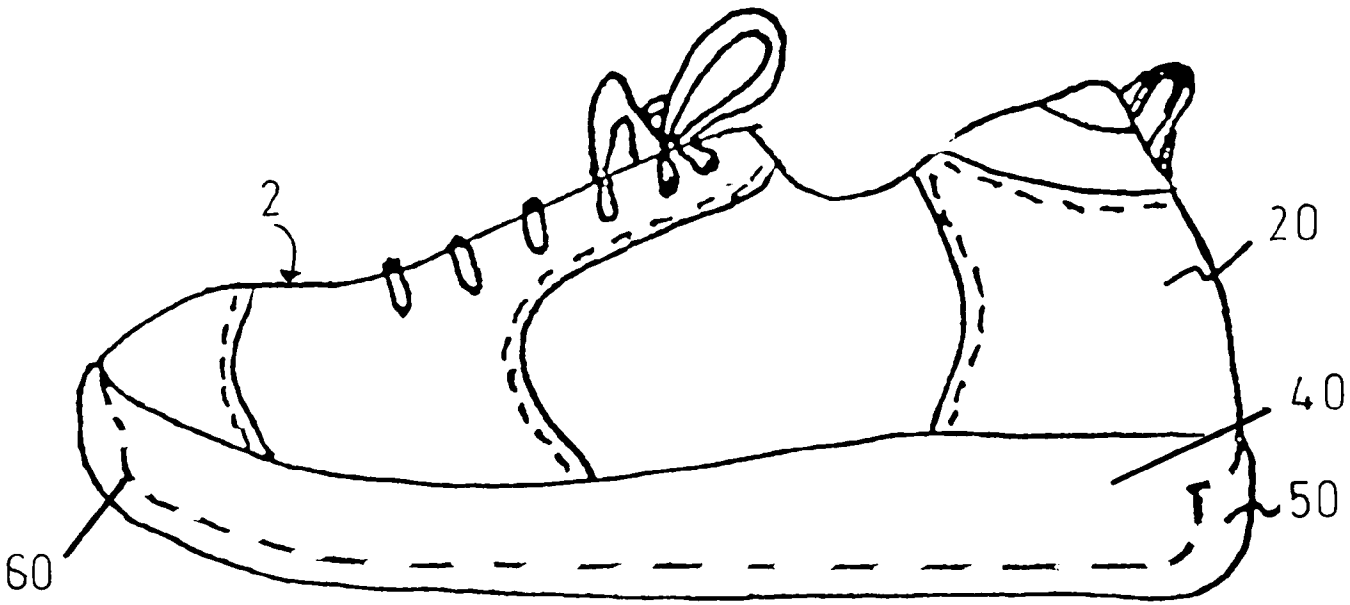
FIG. 1 is a elevated sideview of an article of footwear utilizing and incorporating the most preferred embodiment of the present invention.

The present invention comprises a structural improvement in footwear technology wherein a planar layer of elastic and resilient material: is employed as a stretchsole; is incorporated into the upper of the shoe that houses the foot; and is aligned and positioned adjacent to a preformed median cavity structure of pre-determined dimensions and configuration contained within the outsole unit of the footwear. This construct and improvement in foot cushioning and shock absorption utilizes these two unique components, the stretchsole and the median cavity, in combination as a cushioning system. This construct will allow any general compression forces generated by the person's foot to be absorbed by the elasticity of the stretchsole in the shoe upper, while the preformed median cavity structure and internal spatial volume of the outsole unit enables the shoe upper to expand. This system allows the person's foot to move and decelerate within the shoe upper as part of the cushioning process. The present invention also allows the stretchsole to expand in the direction of the generated compression force and then to retract and rebound and to release part or all of that force for subsequent absorption.

The Key Factors of the Present Invention:

The present invention provides not less than four key factors as well as offers multiple benefits and advantages in footwear technology, all of which demonstrate its unique capabilities and functions. Each essential factor is described individually below.

A first key factor is the use of an unique elastic stretchsole which is joined to the shoe upper and is aligned with a preformed median cavity positioned within the outsole unit of the footwear. This structural combination, the stretchsole and the median cavity, serves to decelerate and control the compression forces generated by the person's foot; and acts to cushion the forces upon the wearer's foot by allowing the elastic stretchsole to deform downward past the boundaries of the shoe upper into the interior of the outsole unit. The present invention thus allows the stretchsole within the shoe upper to expand with and in the direction of the generated compression forces; to enter the spatial volume provided by the median cavity structure in the outsole unit; and then to retract and rebound back into the shoe upper, and release part or all of that compression force for subsequent absorption.

A second major factor is the undisputed fact that most conventional outsoles and insoles are typically made from materials such as ethylene vinyl acetate (EVA), polyurethane (PU), or rubber—all of which are commonly known to be ineffective agents for shock absorption or foot cushioning purposes. It has long been recognized that compositions such as EVA and PU result in a "bottoming out" of the shoe in a rather abrupt manner, the severity varying with the impact generated during the walking or running activity (up to 3 times the body weight of the wearer and as great as 8 times the body weight during more aggressive activities and sports). In distinction, the present invention provides a stretchsole joined as an end closure to the shoe upper. The stretchsole is a planar layer of elastic material which will allow the wearer's foot to move downwardly within the upper in the direction of the compression forces; and to become deformed an additional twenty percent or more over that permitted by traditional EVA and/or PU materials today. The use of the elastic stretchsole comprising part of the present invention will limit and avoid the "bottoming out" event associated with most footwear today and will provide an energy return as the elastic material rebounds back into its original dimensions and shape.

In addition, the footwear industry employs the term "Compression Set" as the parameter by which to measure the ability of a foam to return to its original thickness after being compressed/deflected between two parallel plates at a specific temperature and time duration. The Compression Set values and parameter for many conventionally used foams (such as EVA or PU) will compress and be reduced in volume upwards of 50 percent within the initial three to six months of wear, depending upon usage. In comparison, the present invention provides the capability to work with many different elastic and resilient materials having a decreased Compression Set value and having properties other than those offered by foams such as EVA or PU. This capability and value will help extend the performance properties for the article of footwear whatever its intended use.

A third key factor is that footwear cushioning typically is part of or is structurally joined to the conventional outsole of the footwear. In contradistinction, the construct and system of the present invention utilizes an unique stretchsole, a planar layer of elastic material, which is joined solely to the shoe upper and has no direct structural connection to the outsole unit of the footwear. This construct and system of cushioning is highly desirable because of the ease of its manufacture and its unusual capability to provide a decelerating effect far different from that in conventionally available footwear.

A fourth essential factor is that the present invention provides a construct and foot cushioning system for absorbing the compression forces generated by the person's foot by using a construction design and materials which are unusually light weight, resilient, and conforming to the wearer's foot. Because of the invention's requirement for a median cavity within the outsole unit, there will be less material needed to support the weight of the wearer, and therefore a lighter-weight footwear with an improved cushioning system will be the result.

Additional Features, Advantages, and Benefits of the Present Invention:

(i). The article of footwear will offer foot cushioning via an elastic stretchsole.the stretchsole is a planar layer of material stitched/adhered to the upper of the shoe; is situated at the base of the foot; and provides an integrated end closure for the shoe upper. This stretchsole will create a "trampoline effect" as it deforms within the shoe when the wearer's weight presses down upon the elastic material and will protrude into the preformed median cavity within the outsole unit of the shoe. Once the wearer's foot is in the upward "swing" portion of the gait cycle, the elastic material composing the stretchsole will then rebound, thereby creating a form of energy return within the shoe. This stretchsole, although permanently affixed as an elastic sheet to the shoe upper, will create added comfort for the wearer.

(ii). A desirable feature of the present invention is its ease of manufacturability. The use of Strobel construction within the footwear manufacturing process is quite common, including the prevalence of Strobel stitching machines within the industry. The considerable cost savings for this mode of construction and the enhanced flexibility that this construction provides is commercially very desirable. The present invention is ideally suited for use in shoes having Strobel construction.

(iii). Another benefit of the present invention is the added layer of comfort which can now be included within the shoe. Rather than a using stiffer EVA, PU or rubber compound within the outsole unit to absorb the impact of a foot in motion, the stretchsole will absorb this motion via a deformation and expansion into a preformed cavity in the outsole unit, thus softening the impact stage of the normal gait cycle.

(iv). An advantage of this invention is an added flexibility to the outsole unit of the footwear. Traditionally, the thickness and weight of a conventional rubber outsole would severely limit and retard the flexibility of the shoe's upper. Thus the present invention, by effectively removing the substantive thickness of the conventional outsole and substituting a preformed medial cavity structure, the forefoot of the resulting shoe will be allowed to flex more naturally with the gait of the wearer.

(v). Another feature of this invention is the ability to control the level of cushioning by changing the type or form of elastomeric material being used as the stretchsole. Activities such as walking present a different set of cushioning requirements versus other activities such as basketball or jogging (where the force of impact generated can be 3–5 times higher than that of walking). By regulating the type of elastomer being used and/or the durometer (hardness) of the elastic material, the elastic properties of the stretchsole can be controlled to meet the cushioning requirements of a specific activity.

(vi). Another useful benefit of the invention is the capability to provide an improved energy return system for the footwear. This capability is a consequence of the rebound effect of the stretchsole, the planar elastic material, "springing back" to its original dimensions and former shape after having protruded into the median cavity of the outsole unit.

(vii). Another advantage of this invention is its air ventilation effect within the shoe. Owing to the stretchsole deforming and protruding into the preformed median cavity of the outsole unit, a volume of air may become, depending on the composition and nature of the stretchsole, internally displaced and is forced upward into the body of the shoe upper, thus creating a cooling effect for the feet.

(viii). Still another feature of the present invention allows the downward thrust of the foot past the horizontal lasting shelf for interaction with other matter lying within the median cavity structure of the outsole unit. The other matter lying aligned and beneath the stretchsole can include, but is not limited to, materials such as lower density foams (PU or EVA) and marketed fluid capsulation technologies such as Nike Air Bags, Nike Shox, Reebok PU Honeycomb, Reebok DMX, Asics Gel pads, etc. Currently, many of these capsules sit within an existing heel or forefoot space, with a non-stretch Strobel cloth material. However, because of the non-stretch characteristics of traditional and conventionally used lasting material, the foot is not able to benefit from the cushioning placed within the outsole unit. In distinction, the present invention utilizes a stretchable lasting material and allows the foot to depress the conventional cushioning technology within the traditional shoe and give an added measure of comfort to the wearer.

The construct and system of foot cushioning which is the subject matter as a whole comprising the present invention can be assembled in a variety of different embodiments and in a range of preferred and alternative forms. Accordingly, in order to properly recognize and fully appreciate the unique merits and substantive structural features of the invention, the detailed disclosure will present a variety of different embodiments ranging from the most preferred to alternative useful and desirable constructs.

A PREFERRED EMBODIMENT

A preferred footwear construction and arrangement comprising the present invention is illustrated by FIGS. 1–11 collectively. However, many of the features constituting the footwear construction, assembly, and interactions are shared among all the different and varying embodiments of the present invention, without regard to particular details or preferences. For these reasons, the description of a preferred embodiment will be presented in extreme detail in order that all the subsequent embodiments disclosed hereinafter, whether preferred or alternative, need not be presented in merely repetitive and needless particulars.

Accordingly, FIG. 1 shows a side view of a preferred embodiment. As seen therein, fully assembled shoe 2 is illustrated as an athletic shoe; and comprises upper assembly 20 and outsole unit 60. Outsole unit 60 itself is an integrated unitary article comprising median cavity zone 40 and outer shell 50, which serves as an exterior bottom for the footwear.

Figure 2:
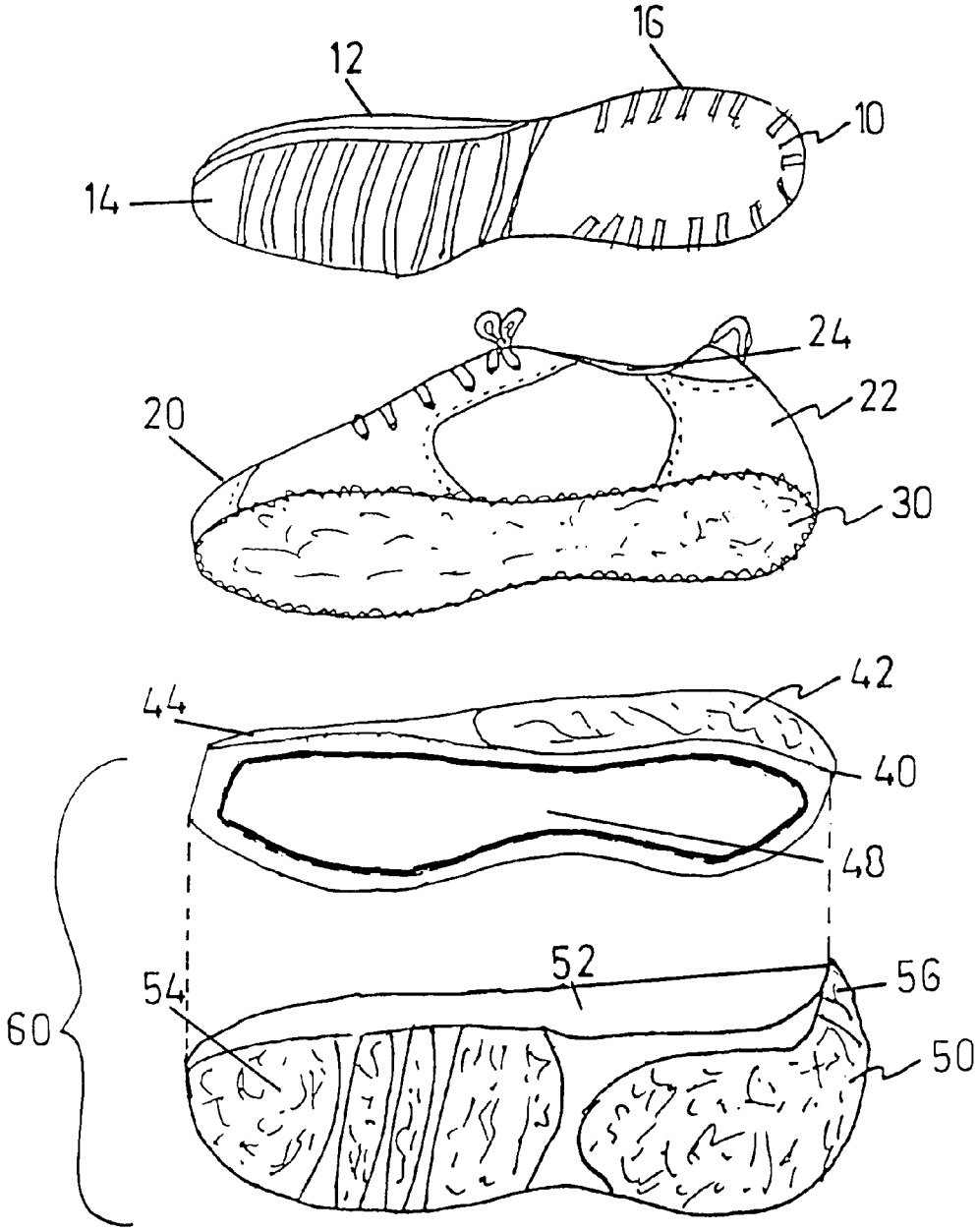
FIG. 2 is an exploded view of the component parts comprising the preferred footwear of FIG. 1.

FIG. 2 shows an exploded view of the different component parts comprising the fully constructed and assembled shoe. As shown therein, insole 10 is illustrated uppermost and serves an insert into the interior of the shoe itself. Insole 10 comprises top surface 12 intended for direct contact with the foot, bottom surface 14, and perimeter edge 16.

Upper assembly 20 is shown as comprising upper shoe portion 22 and stretchsole 30, which are joined together in combination to form an integrated unit.

Also, shown by FIG. 2, outsole unit 60 comprises two distinct zones, median cavity zone 40 and outer shell zone 50. These two zoned parts of outsole unit 60 are shown as being artificially and intentionally separated from each other within FIG. 2 in order to illustrate specific structural details about each zone and to provide a better overall clarity and understanding for the unified article as a whole.

With this descriptive purpose in mind, FIG. 2 shows median cavity zone 40 as comprising median sidewall 42, lasting shelf 44, an optional series of elastic cavity support columns 46 (not shown in FIG. 2), and a preformed and pre-positioned median cavity 48. FIG. 2 also shows outer shell zone 50 as comprising outer sidewall 52, bottom sole 54, and outer perimeter edge 56. Together, median cavity zone 40 and outer shell zone 50 comprise outsole unit 60 as an integrated and unitary article.

Figure 3:
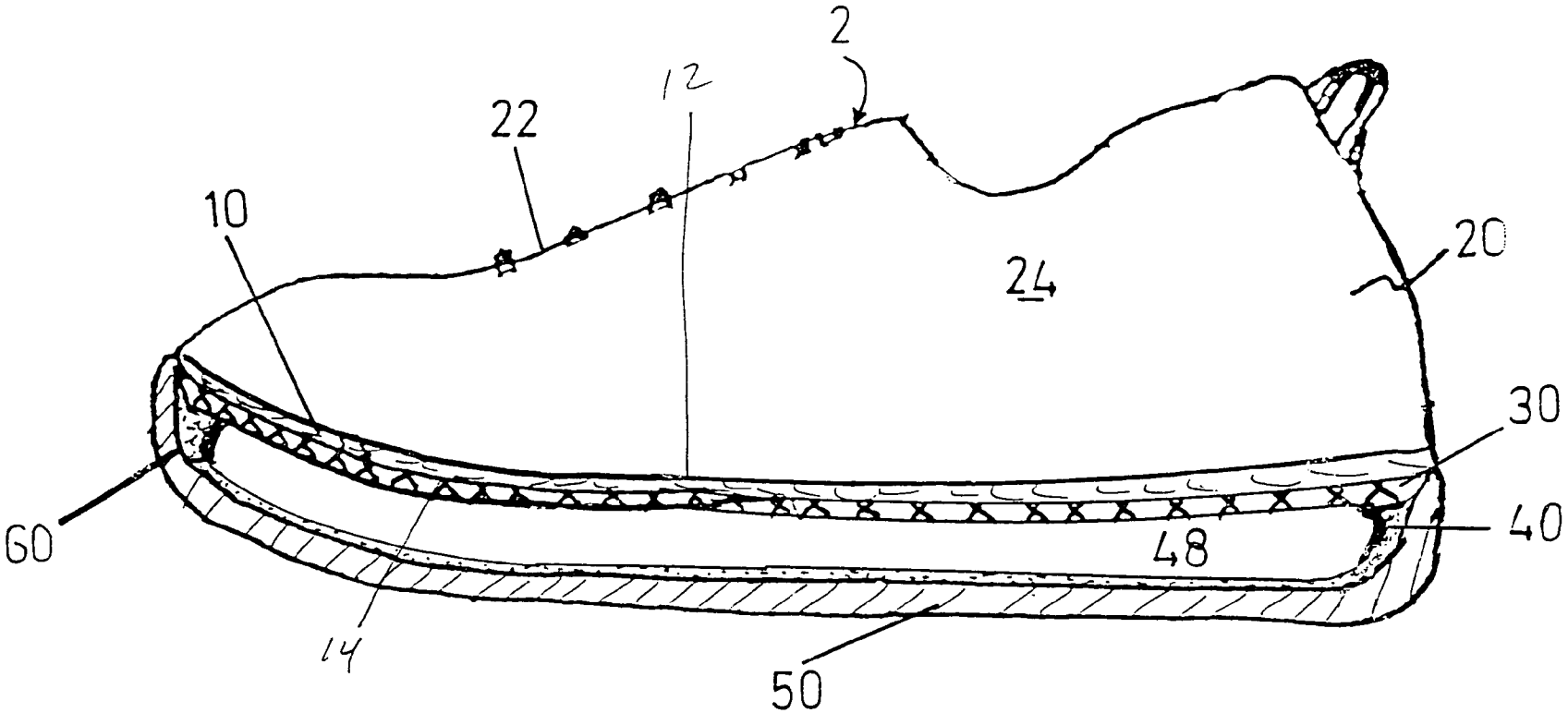
FIG. 3 is a longitudinal cross-sectional view of the preferred footwear of FIG. 1.

FIG. 3 shows a cross-sectional view of the footwear illustrated previously herein by FIG. 1. As illustrated by FIG. 3, the relationship of the different components comprising fully assembled shoe 2 is revealed. Accordingly, outsole unit 60, including median cavity zone 40 and outer shell zone 50 in combination, encompasses and is joined to the lower exterior end of upper assembly 20. Stretchsole 30 is positioned at and permanently joined to the encompassing perimeter edge of upper shoe portion 22 to form an integrated end closure for upper assembly 20; and the joined stretchsole 30 is a planar elastic layer which is deformable and re-formable on-demand and which lies aligned with and adjacent to median cavity 48 of outsole unit 60. Also, insole 10 is shown in its intended position within the interior of upper assembly 20, wherein bottom surface 14 lies against stretchsole 30 while top surface 12 awaits the human foot as a direct contact surface.

Figure 4:
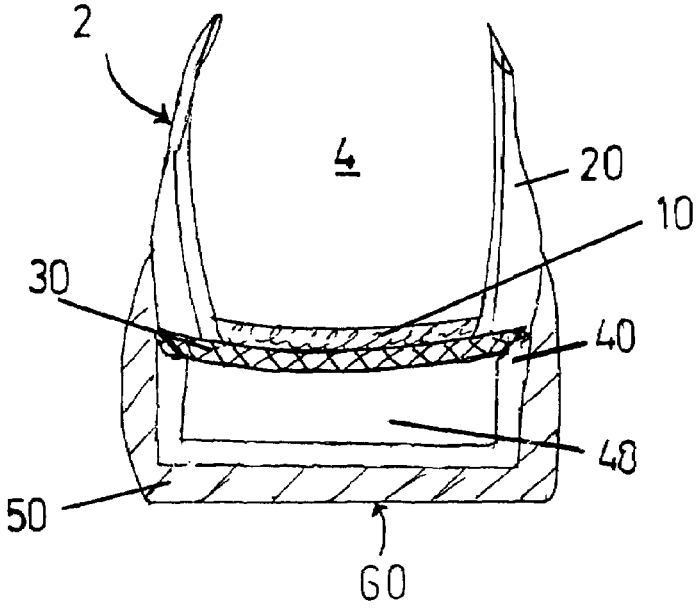
FIG. 4 is a transverse cross-sectional view of the preferred footwear of FIG. 1.

FIG. 4 shows a transverse cross-sectional view of the assembled shoe illustrated previously by FIGS. 1 and 3. As shown by FIG. 4, assembled shoe 2 has foot space 4 in the interior of upper assembly 20. Integrally joined to upper assembly 20 as an elastic end closure is stretchsole 30; and the lower portion of upper assembly 20 is itself joined to and lies situated within outer unit 60. Median cavity zone 40 is shown as a preformed structural member and is contained entirely within the internal volume of outsole unit 60 in fully assembled shoe 2.

Also as previously noted, stretchsole 30 is a deformable and re-formable on-demand planar elastic layer which lies adjacent to and is in parallel alignment with median cavity 48 of outsole unit 60. In this manner of construction and shoe assembly, a defined volume is internally present as a preformed and pre-positioned median cavity 48; and this volume provides a fluid foot cushioning for stretchsole 30 when it deforms into the spatial interior of outsole unit 60.

Figure 5:
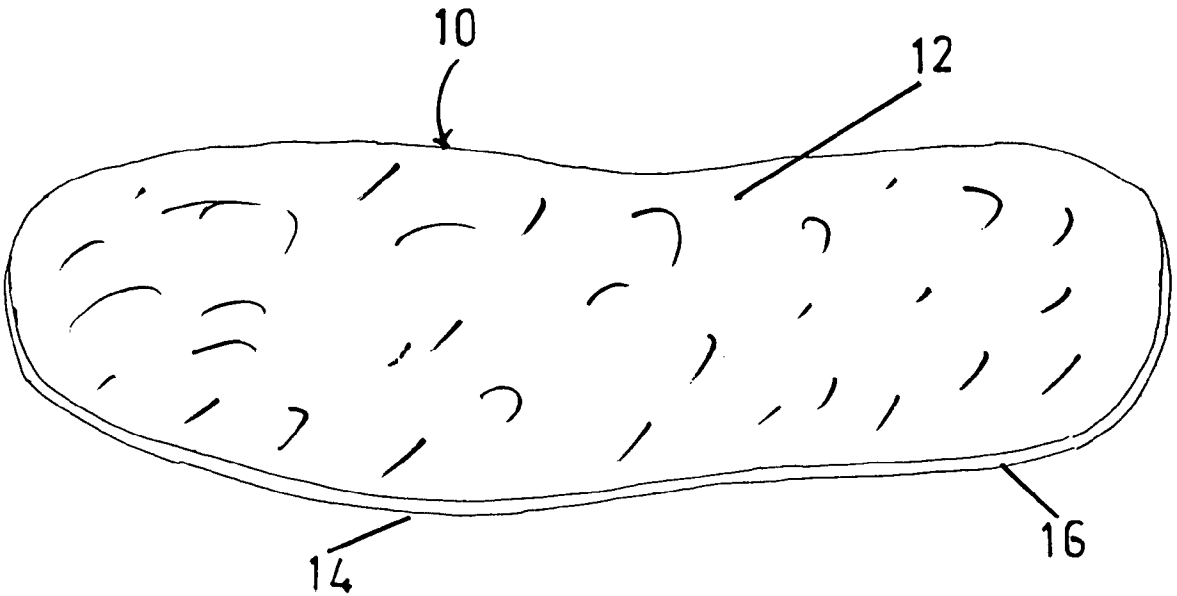
FIG. 5 is an overhead view of the insole in the preferred footwear of FIG. 1.

FIG. 5 provides a detailed view of insole 10 intended for inclusion within assembled shoe 2. As shown therein, insole 10 has top surface 12, bottom surface 14, and perimeter edge 16. Insole 10 is typically formed of resilient material; and top surface 12 is the exposed surface upon which the person's foot will rest.

Figure 6A:
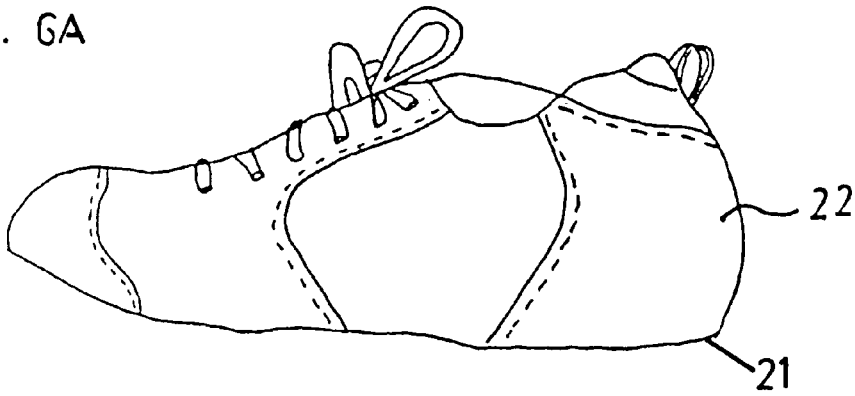
FIGS. 6A–6C are side views of the components comprising the upper shoe portion of the preferred footwear of FIG. 1.
Figure 6B:
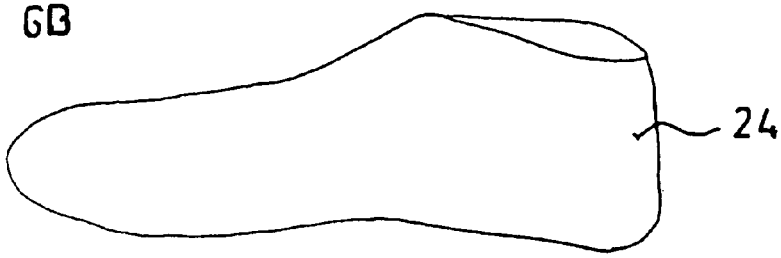
Figure 6C:
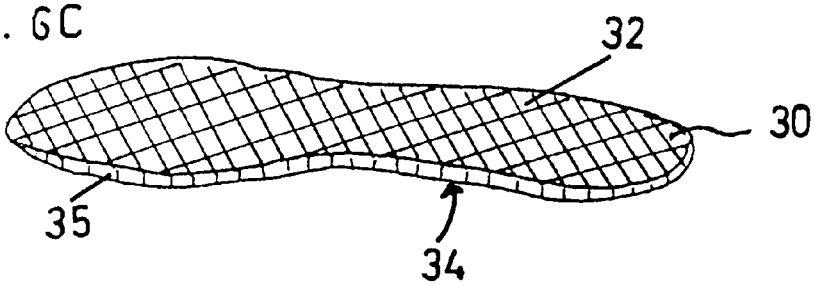

FIGS. 6A, 6B, and 6C respectively show the details of the upper assembly. Upper shoe portion 22 illustrated by FIG. 6A has an encompassing perimeter edge 21 which defines the shape and axial length of fully assembled shoe 2 and is tailored to meet the size dimensions of the wearer's foot. FIG. 6B shows that within the interior of upper shoe portion 22 is last 24, a solid plastic form over which the shoe upper is made and which determines the size, shape and certain style features of the shoe. Last 24 is removed from the shoe prior to packaging. Stretchsole 30 is shown by FIG. 6C as having upper surface 32, lower surface 34, and perimeter edge 35. Both components of FIGS. 6A and 6C as a whole (upper shoe portion 22 and stretchsole 30) are integrally joined to make upper assembly 20.

It will be recognized and appreciated that stretchsole 30 is an unique feature and unusual innovation that is part of and is positioned solely within upper shoe portion 22 of shoe 2. Stretchsole 30 is composed of durable elastic materials such as elastic webbing, thermal plastic resin (TPE), rubber, nylon, latex, polyurethane and/or polyurethane-containing elastomers. The thickness of this layer of material may vary from approximately 0.2 to 5.0 millimeters (mm) and this planar sheet of elastic material will be stitched and/or adhered to encompassing perimeter edge 21 to form an integrated end closure for upper assembly 20. Stretchsole 30 typically is a single planar sheet of elastomeric material which will be Strobel stitched or glued to encompassing perimeter edge 21 of upper shoe portion 22 in a manner to permanently affix and adhere the elastic material to upper. This arrangement is illustrated by FIGS. 7A, 7B, and 7C respectively.

Figure 7A:
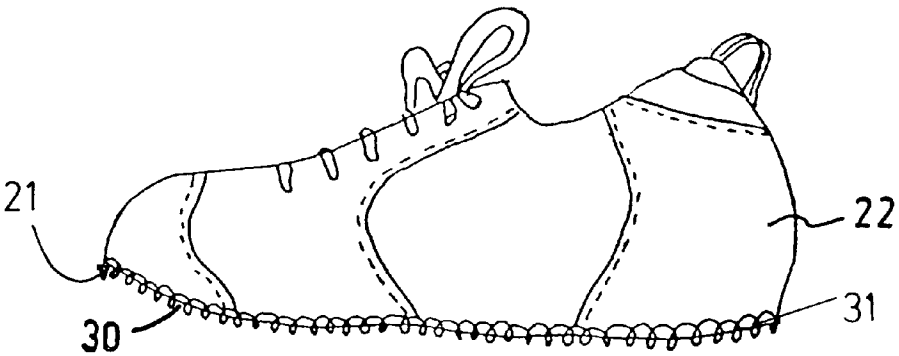
FIGS. 7A–7C are alternative views of the upper shoe assembly in the preferred footwear of FIG. 1.
Figure 7B:
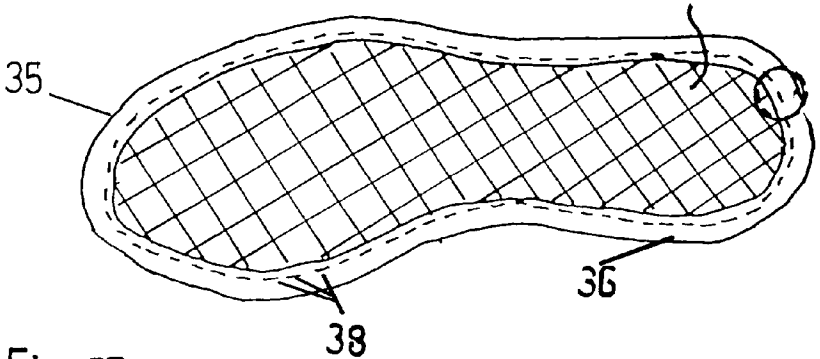
Figure 7C:
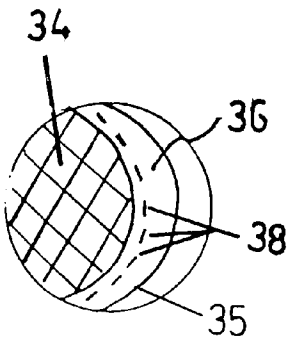

As shown by FIGS. 7A–7C respectively, the lower surface 34 and perimeter edge 35 of stretchsole 30 desirably has binding tape 36 adhered to it via traditional thread stitching 38 or an adhesive (not shown) in order to give structural integrity and strength to perimeter edge 35 of stretchsole 30 when being Strobel stitched 31 to perimeter edge 21. Such thread stitching 38 and/or adhesive adds an additional measure of reinforcement for stretchsole elastomer when joined to encompassing perimeter edge 21 of upper shoe portion 22. This Strobel stitching manner of attachment is conventionally known and is typical part of the manufacturing process employed today in the construction of athletic footwear.

In addition, elastic materials in the form of a discrete planar stretchsole layer can be joined to the shoe upper, including, but not limited to the following forms of footwear constructions:

a. Cold Cement Construction via Strobel stitching or traditional cement (adhesive) construction: Strobel stitching machine would attach upper shoe portion 22 to the single layer of elastic material constituting stretchsole 30. This assembled upper would then be adhered to the outsole unit 60 via use of adhesives and heat. Note that cold cement construction can also be used via "cementing" (not Strobel Stitching) upper shoe portion 22 to the stretchsole 30 material.

b. Cold Cement Construction via Strobel Stitching and Outsole Arriance Stitching: A construction, as stated in (a) above, but which would also include an Arriance stitch within the sidewalls of the outsole unit 60 to help secure upper shoe portion 22 to outsole unit 60.

c. Opanka Construction: The assembled upper shoe portion 22 is stitched around the contour of perimeter of outsole unit 60 d. Stitch-Out Construction: Common to all footwear is the basic construction principle of flanging the upper out over the top of the sole extension and fastening the sole to the upper by stitching through this outflanged margin. It is the only construction where the lasting margin is turned outward.

e. Goodyear Welt Construction: This format employs four layers of materials including the outsole, welt (flat strip of leather or other material laid over top edge of the outsole), insole and underflaps (margins), all of which are sewn together with a special lockstitch.

f. Vulcanized Construction: Similar to (a) above, but upper assembly 20 would then be adhered via a vulcanization process which includes adhering strips of uncured rubber to the outsole walls and then baking them in an (vulcanizing) oven for approximately 70 minutes until rubber is cured and therefore adhered to the upper.

Note: All forms of the above footwear constructions would include the use of primers, cements, adhesives, etc. as part of the normal footwear construction process.

The elastomers constituting stretchsole fabric are materials which can have varying elongation ratios, the variance depending upon the activity for which the footwear is intended. For example, an elastomer material having a higher elongation ratio (a greater stretch and deformation capability) can be used for a less strenuous adult activity such as walking; or be used for children's shoes which will have a lightweight impact. Conversely, an elastomeric material with a lower elongation ratio (a decreased and limited stretch capacity) can be used for adult shoes where more high performance or weight bearing impact activities (such as basketball or jogging) are encountered routinely.

Figure 8:
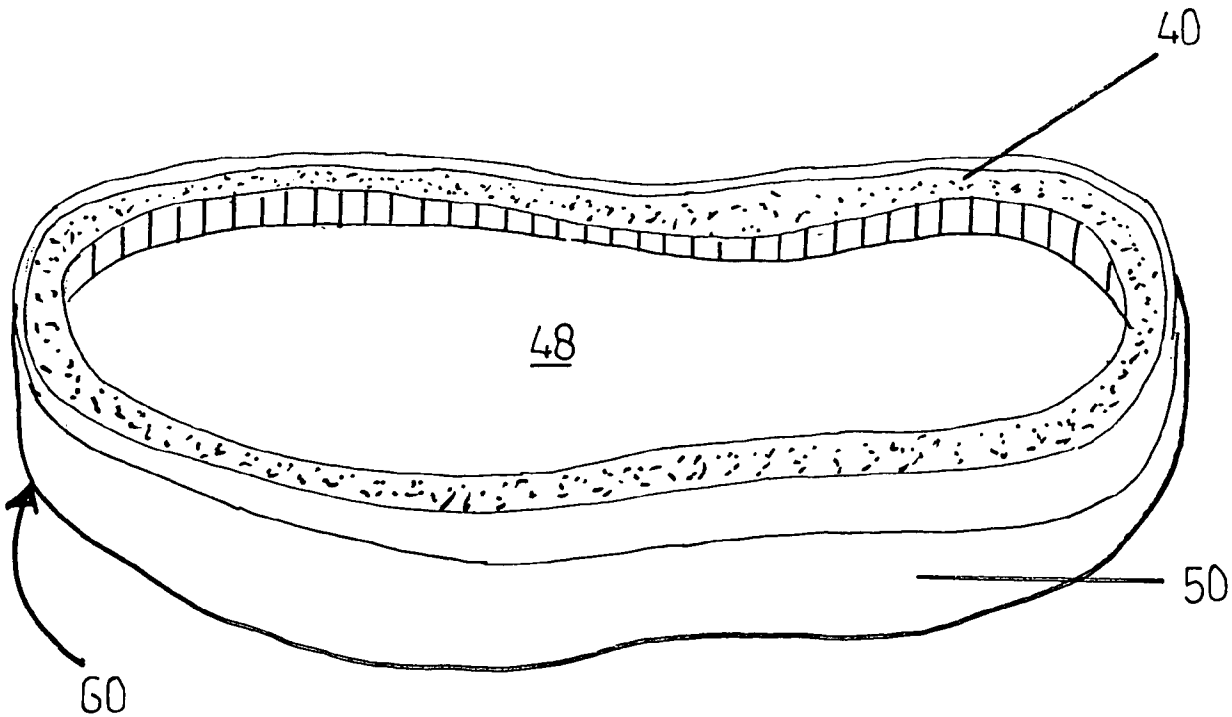
FIG. 8 is an overhead view of the outsole unit in the preferred footwear of FIG. 1.
Figure 9:
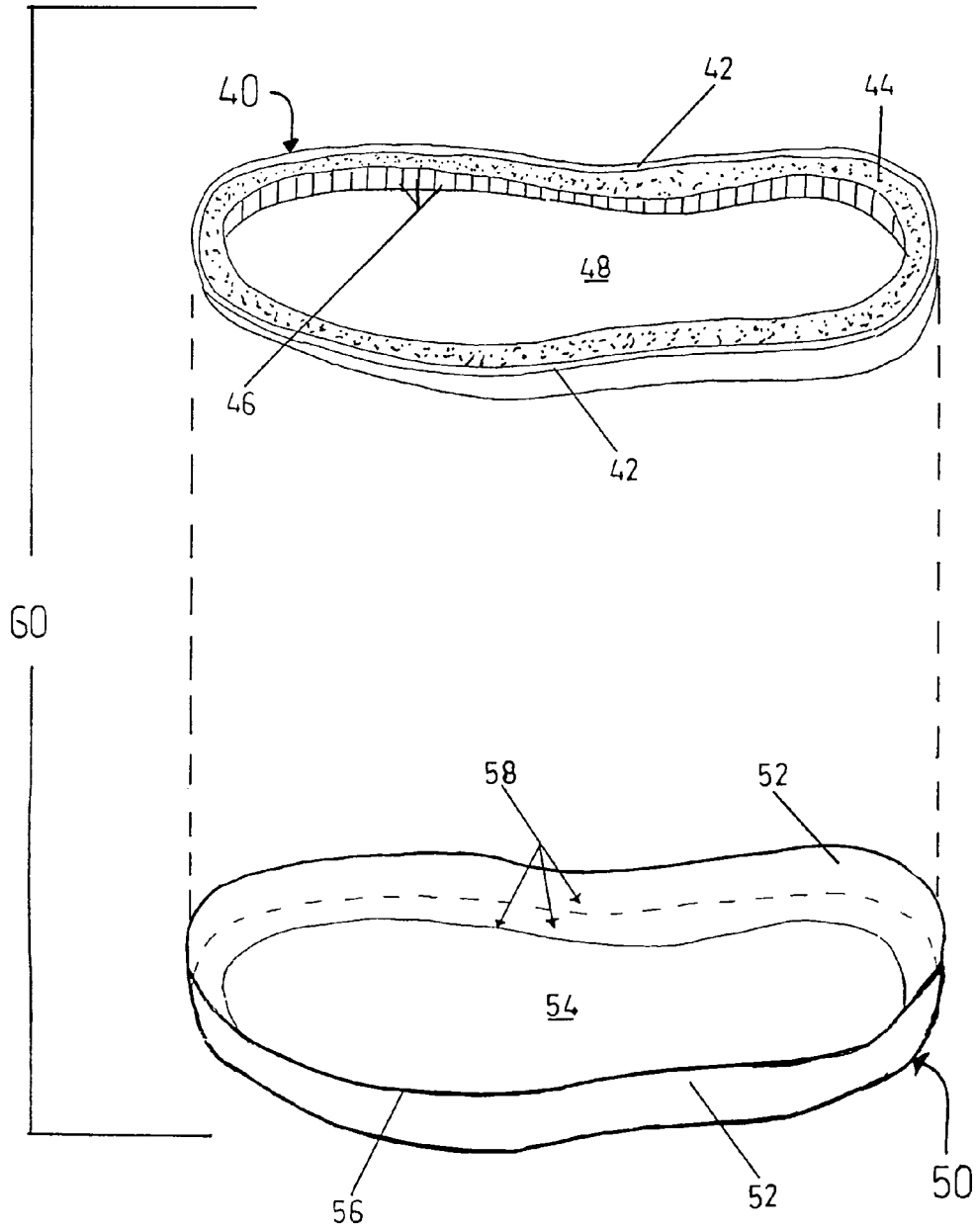
FIG. 9 is an artificially and intentionally exploded view of the detailed features of the outsole unit in the preferred footwear of FIG. 1.

For this preferred embodiment, FIGS. 8 and 9 respectively illustrate and reveal the details of outsole unit 60. Note that FIG. 8 shows outsole unit 60 as it actually exists in reality, as a single integrated entity. FIG. 9 shows the same outsole unit 60 as in FIG. 8, but now introduces and illustrates an artificial and intentional separation of median cavity zone 40 distinct from outer shell zone 50. FIG. 9 is therefore provided merely to offer visual perspective and additional clarity for the particular features and details of outsole unit 60 as a single integrated whole.

As shown by FIGS. 8 and 9, outsole unit 60 comprises median cavity zone 40 and outer shell zone 50. Median cavity zone 40 comprises median sidewall 42, lasting shelf 44, and an optionally present series of elastic cavity support columns 46; and these structural components, acting in common with outer shell zone 50, collectively form and outline the top portion of a preformed cavity chamber which lies entirely within outsole unit 60 and delineates median cavity 48.

FIGS. 8 and 9 also reveal that outer shell zone 50 of outsole unit 60 comprises outer sidewall 52, bottom sole 54, and outer perimeter edge 56. Outer shell zone 50 is molded to provide volumetric recession 58, a spatial volume, which is outlined, configured and delineated by outer sidewall 52, bottom outer sole 54 and outer perimeter edge 56 in combination. It will be noted that the dimensions and configuration of volumetric recession 58 are contiguous with the structure of median cavity zone 40; and as such, volumetric recession 58 outlines and delineates the lower portion of a preformed cavity chamber which lies internally within outsole unit 60 and defines median cavity 48. Volumetric recession 58 is also the structural entity holding most of the fluid volume comprising median cavity 48.

In this preferred embodiment therefore, the dimensions and volume of median cavity 48 will be fixed via a cavity chamber structure which typically extends over almost the entire axial length, width and depth of outsole unit 60; and, via the extended three-dimensional size and volume of this collectively formed cavity chamber, includes a fixed volume of ambient air as median cavity 48 within outsole unit 60. In this manner, median cavity 48 is: structurally created and encompassed by median cavity zone 40 and outer shell zone 50 in combination; housed and contained by the collectively formed cavity chamber within the interior of outsole unit 60; and will function to support and cushion the person's foot over the entire length of the assembled shoe.

In the most preferred embodiments of the invention, there will be only one preformed cavity chamber per assembled shoe; and the largest possible volume of ambient air will exist as median cavity 48 within outsole unit 60. In this manner also, the wearer's foot will be completely supported over its entire length from toes to heel within the shoe; and the normal gait cycle (including the five stages of heel strike, foot flat, heel off, knee bend, and toe off) will be cushioned and be shock absorbing throughout the entirety of the wearer's gait.

It will be therefore noted and appreciated that, as shown by FIGS. 8 and 9, the preferred embodiment of the present invention provides a construct and foot cushioning system which effectively eliminates both the existence and the use of the conventional solid or substantive midsole as such. Instead, a uniquely structured outsole unit 60 is employed as a complete substitute and structural replacement for the traditional substance and solid thickness of the conventionally known midsole.

Also, it is most desirable that outsole unit 60 as a whole (including median cavity zone 40 and outer shell zone 50) be a single, unitary structural entity; be constructed of resilient elastomeric material; and provide a demonstrable degree of flexibility and expansion for median cavity 48 in order to enhance further its foot cushioning and shock absorbing capabilities.

Figure 10:
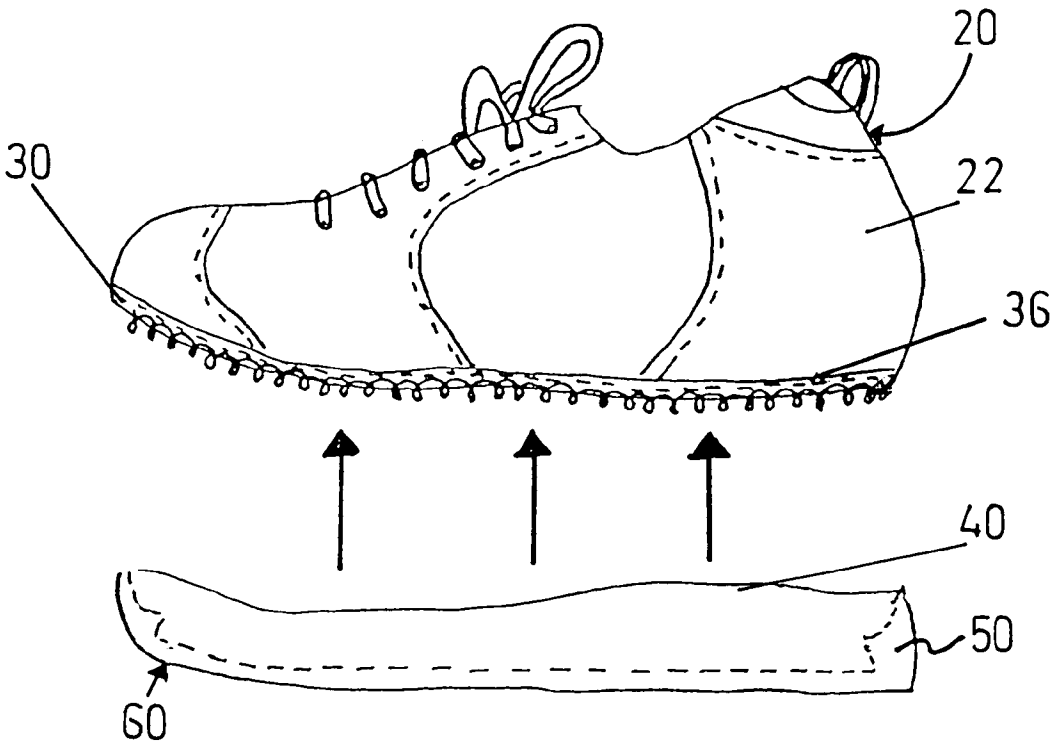
FIG. 10 is an exploded view of the mode of assembly employed for the preferred footwear of FIG. 1.

The manner of assembling fully assembled shoe 2 is illustrated by FIG. 10. As shown therein, outsole unit 60 (comprising median cavity zone 40 and housing the entirety of median cavity 48) is joined to the exterior of upper assembly 20 in a manner that permanently joins these component parts together and integrally affixes them to one another. The manner of attachment of outsole unit 60 to the exterior of upper assembly 20 is desirably made using one of the following types of construction: Cold Cement construction; Vulcanized construction; Hand Sewn construction; Stitched-Out construction; Opanka construction; and/or Goodyear Welt construction. All of these attachment methods have been described previously herein. If desired, other methods and materials for joining outsole unit 60 to upper assembly 20 may also be employed at will, so long as the juncture forms a permanently unified and integrated construction.

Figure 11A:
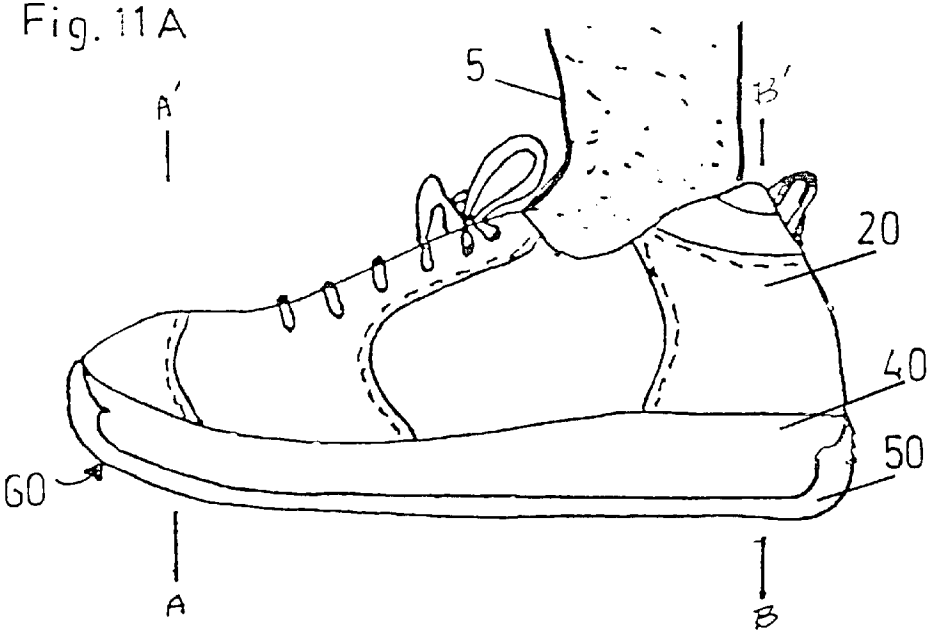
FIGS. 11A–11C are different views of the foot cushioning construct and shock absorbing effect of the preferred embodiment.
Figure 11B:
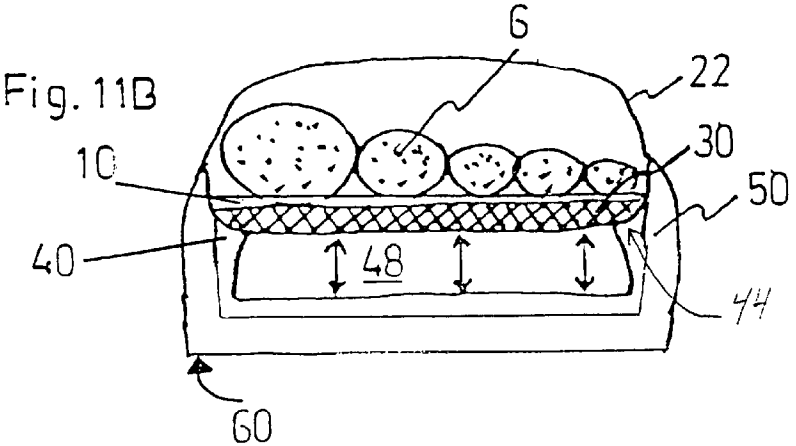
Figure 11C:
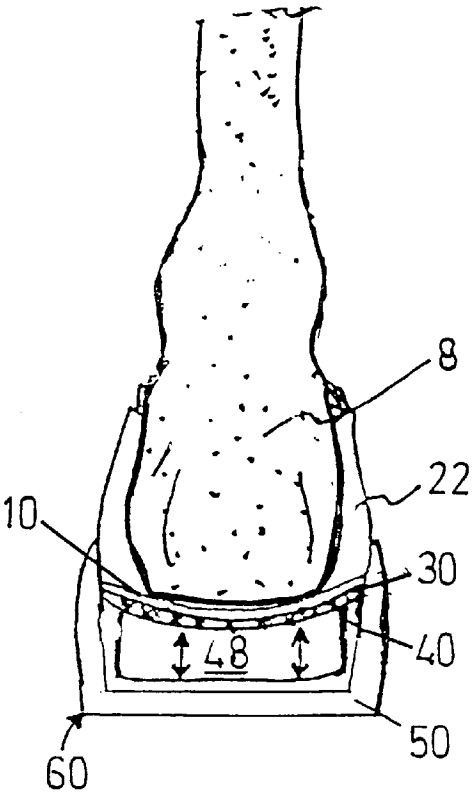

The complete shoe manufactured using the preferred construct and system for foot cushioning and shock absorption is illustrated by FIGS. 11A, 11B, and 11C respectively. FIG. 11A shows a side view of the fully assembled shoe as typically worn on the human foot. FIG. 11B shows a transverse cross-sectional view along the axis AA' of FIG. 11A; and FIG. 11C illustrates a transverse cross-sectional view along the axis BB' of FIG. 11A.

As shown in FIG. 11A, human foot 5 is inserted into the interior of upper assembly 20 and is seen to rest directly on insole 10 and indirectly upon stretchsole 30. The transverse cross-sectional view of FIG. 11B reveals that toes 6 are supported by stretchsole 30 which lies aligned with and adjacent to median cavity 48 of outsole unit 60. Similarly, FIG. 11C reveals that heel 8 of human foot 5 is also supported, cushioned, and protected from shock by the construct and system of the present invention. As seen therein, median cavity 48 accommodates the deforming stretchsole 30 when the weight of the heel rests over it within upper assembly 20.

Figure 12A:
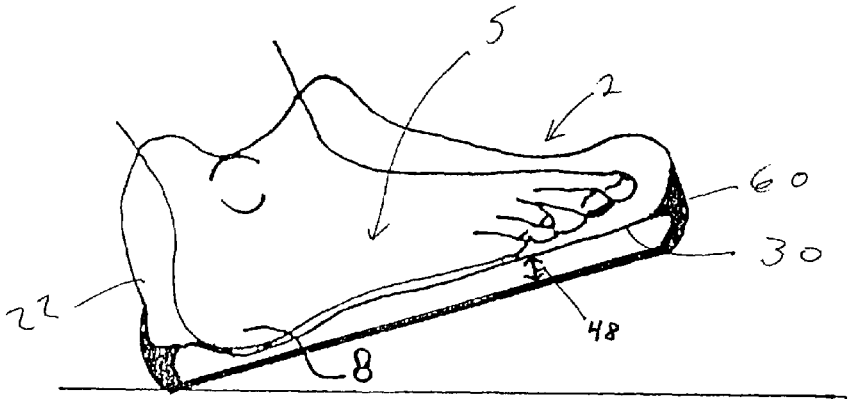
FIGS. 12A–12C are side views of the foot cushioning and shock absorbing effects of the preferred footwear during the normal gait cycle.
Figure 12B:
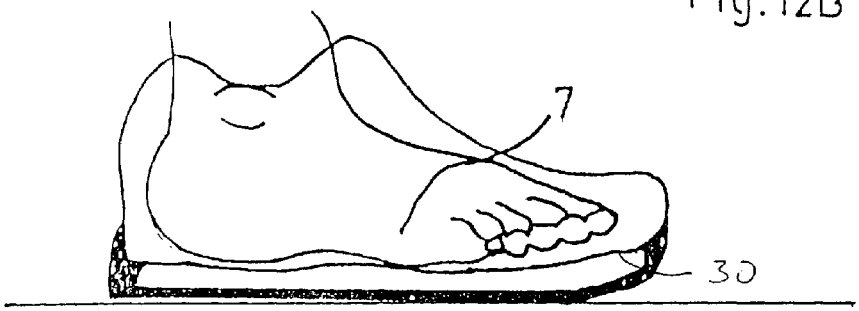
Figure 12C:
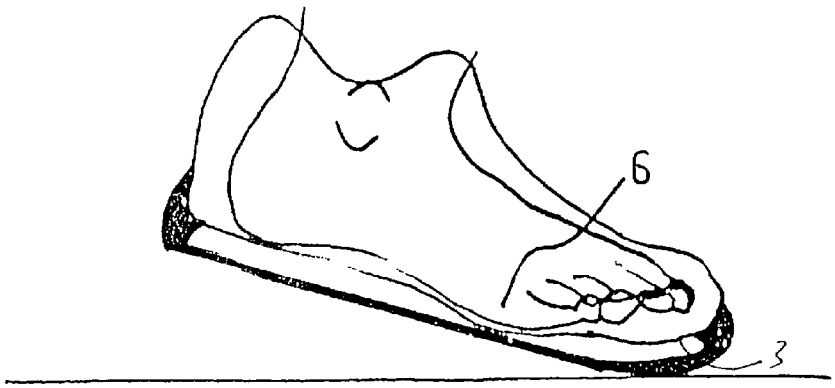

The nature of the interaction between the elastic stretchsole 30 joined to perimeter edge 56 of upper shoe portion 22 (and forming a discrete elastic end closure for upper assembly 20) in relationship to the adjacent cavity structure and median cavity provided within outsole unit 60 of the footwear article is shown by FIGS. 12A–12C respectively. As seen therein, FIGS. 12A–12C show the normal gait cycle of a person wearing fully assembled shoe 2 and reveals the cushioning and shock absorbing effect created by the present invention upon the human foot. As these figures show, stretchsole 30 forming the elastic end closure for upper shoe portion 22 deforms when heel 8, or bridge 7, or toes 6 of human foot 5 generate substantial compression forces. On these occasions, stretchsole 30 deforms initially, enters median cavity 48 of outsole unit 60, and then rebounds repeatedly on demand in response to the repeated compression forces generated thereon by foot 5 and median cavity 48 provided by median cavity zone 40 of outsole unit 60 lying beneath and adjacent to elastic stretchsole 30 will receive stretchsole 30 as it deforms, reforms, and rebounds repeatedly. The foot cushioning and shock absorbing effect is thus achieved and felt on human foot 5 throughout the normal gait; and the compression forces generated on elastic stretchsole 30 by the weight and impact of foot 5 striking the ground become absorbed and subsequently released.

These illustrations therefore show the cushioning effect and shock-absorbing capacity in a high impact use where the person is walking or running or is merely standing still. In each instance (as shown by FIGS. 12A–12C respectively), as elastic stretchsole 30 deforms initially, then retracts, and finally rebounds back into its original configuration and former dimensions—preformed median cavity 48 receives deformed stretchsole 30, supports and cushions the deformed stretchsole 30, and serves as a support for the human foot.

It will also be noted and appreciated that when the weight of the human body is exerted onto foot 5 via the normal gait cycle, human foot 5 will exert compression forces upon stretchsole 30, which in turn will deform and protrude into the spatial volume and ambient environment of the preformed and pre-positioned cavity zone 40 and median cavity 48 housed within outsole unit 60, thus creating the "trampoline effect" within the shoe interior. Moreover, as human foot 5 recedes from upper assembly 20 into median cavity 48 (the deceleration stage of the foot entering cavity 48), the normal sequence of the human gait will allow the elastomeric material of stretchsole 30 to retract and rebound back into its original non-deformed shape (the acceleration stage of the foot when exiting cavity 48). Together, these two stages of deceleration and acceleration create an incremental energy return, and thereby provide an exceptional foot cushioning effect and shock absorption capacity within the footwear.

A FIRST VARIATION OF THE PREFERRED EMBODIMENT

Figures 13A, 13B, 13C:
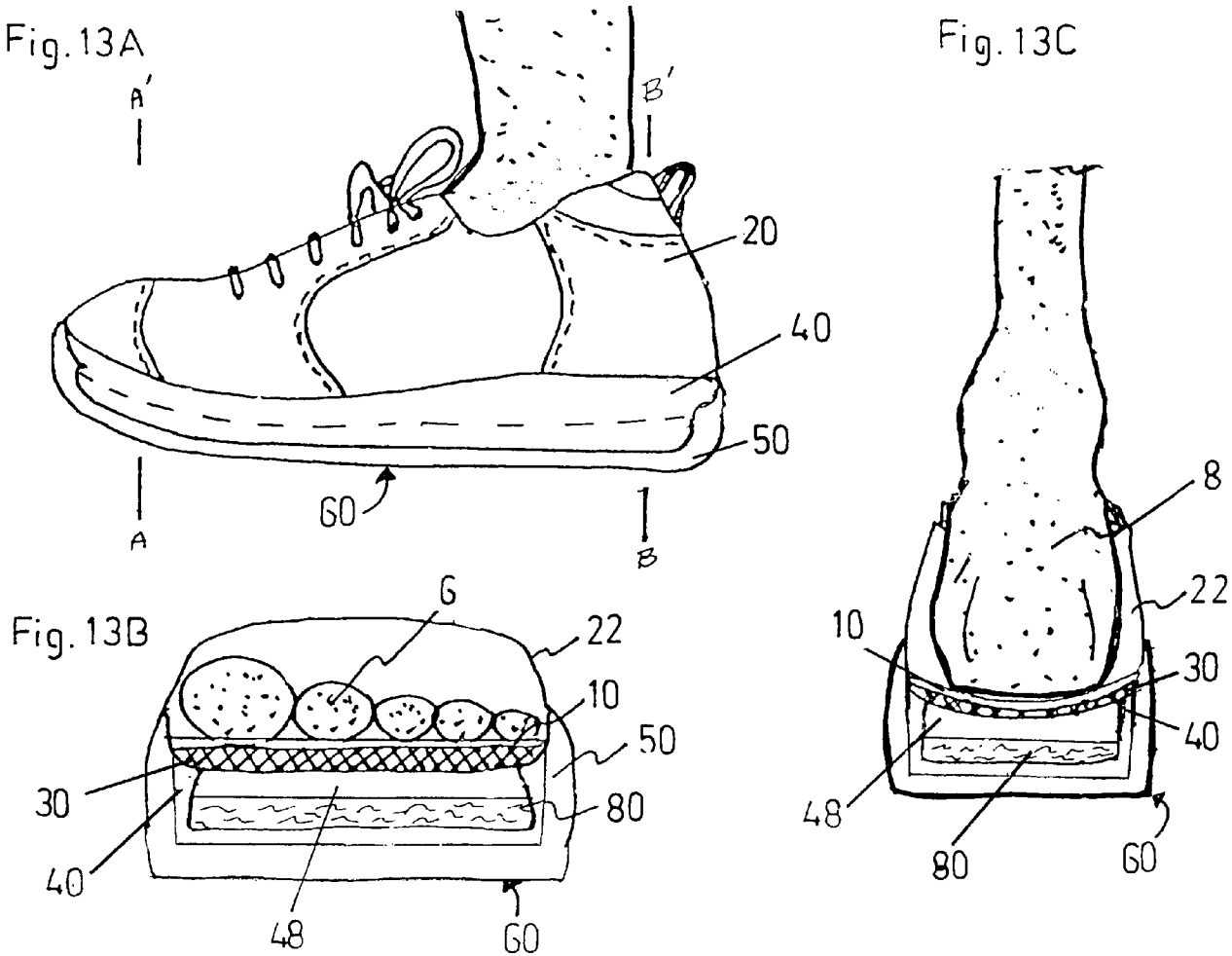
FIGS. 13A–13C are different views of a first variation of the preferred embodiment.

A first variation of the preferred embodiment for the foot cushioning construct and system is illustrated by FIGS. 13A–13C respectively, which is similar to FIGS. 11A–11C described previously herein. FIG. 13A shows a side longitudinal view of the second preferred embodiment in a footwear article worn on the foot; FIG. 13B is a transverse cross-sectional view along the axis AA', the toe area of the footwear; and FIG. 13C is a transverse cross-sectional view along the axis BB' and reveals the heel area of the footwear.

This variation in the preferred embodiment of the footwear uses the same component parts of the assembled shoe described earlier. These include insole 10, upper assembly 20, and outsole unit 60, as well as the arrangement of these component parts into a fully assembled shoe. The first variation of the preferred embodiment previously described herein lies in the inclusion of foam layer 80 within median cavity 48 within outsole unit 60. The material constituting foam layer 80 can be formed of polyurethane, or be a viscoelastic foam, or any other conventionally known form of foam which will become compacted when exposed to compression force. The thickness of foam layer 80, as shown within FIGS. 13B and 13C, will typically range from 2.0–25.0 millimeters. Foam layer 80 can also have differing levels of hardness or density (durometers), depending upon the quantity of compression and dampening effect that is required or desired for that particular article of footwear. This first variation is otherwise identical in all respects to the preferred embodiment described previously.

A SECOND VARIATION OF THE PREFERRED EMBODIMENT

Figure 14:
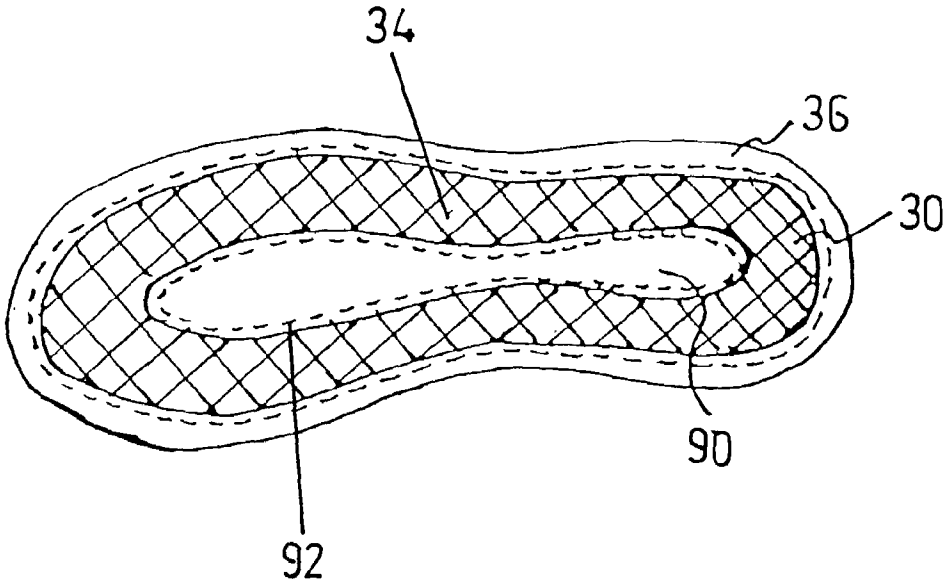
FIG. 14 is an overhead view of a second variation of the preferred embodiment.

The second variation of the preferred embodiment is similar to the format described previously by FIGS. 1–11 respectively herein; and offers a difference in the construction and materials for stretchsole 30, which are joined to encompassing perimeter edge 56 of upper shoe portion 22 to form a discrete elastic end closure for upper assembly 20. FIG. 14 illustrates stretchsole 30 as previously described herein in the preferred embodiment. The variation and further improvement in the stretchsole 30 construction, however, lies in the form of a non-stretch material addition 90 which has been joined to lower surface 34 of the planar layer. Typically, this non-stretch material addition 90 is smaller in dimensions, but conforms in configuration to the overall shape and form of the planar stretchsole 30; and the value of non-stretch material addition 90 lies in the ability of this added piece of material to help regulate and control the amount of elasticity and deformation for stretchsole 30 when stretchsole 30 protrudes into the adjacent median cavity 48 of outsole unit 60. Non-stretch material addition 90 is desirably stitched and/or adhered 92 to the elastomeric material constituting stretchsole 30 itself; and does not allow stretchsole 30 to deform fully or to expand completely as it enters cavity zone 40 and median cavity 48 of outsole unit 60 during the normal gait cycle of the wearer.

For manufacturing purposes, it would be easier to use a consistent type or composition of elastomer for stretchsole 30, but because different shoes are worn for different kinds of activities, non-stretch material addition 90 would be composed of a range of different materials, thus allowing either a greater or lesser capacity for stretchsole 30 to deform to meet the intended cushioning requirement. Therefore, although the same elastomer material could be used for stretchsole 30 in a child's shoe (presuming the child's weight to be approximately 50 pounds), in comparison to an adult's shoe (presuming the adult's weight to be 150–200 pounds), the inclusion and use in the latter of non-stretch material addition 90 on lower surface 34 would provide incremental strength and a governing effect which would prevent the elasticity of stretchsole 30 from expanding and deforming completely. This would allow the deformation and expansion of stretchsole 30 to conform better to the varying weight of the person intending to wear the shoe. Non-stretch material addition 90 would also prevent the elastomeric material of stretchsole 30 from exhaustion; and avoid the "bottoming out" effect due to the varying incremental weight of the wearer.

A THIRD VARIATION OF THE PREFERRED EMBODIMENT

A third variation of the preferred embodiment is illustrated by FIGS. 15A–15D respectively; and reveals another improvement in the construction of the elastic stretchsole. This variation is similar in all other respects to the invention described previously herein by FIGS. 1–11 respectively; and provides an unique structural difference in elastic stretchsole 30 joined to encompassing perimeter edge 56 of upper shoe portion 22 and which forms a discrete elastic end closure for upper assembly 20.

Figures 15A, 15B, 15C, 15D:
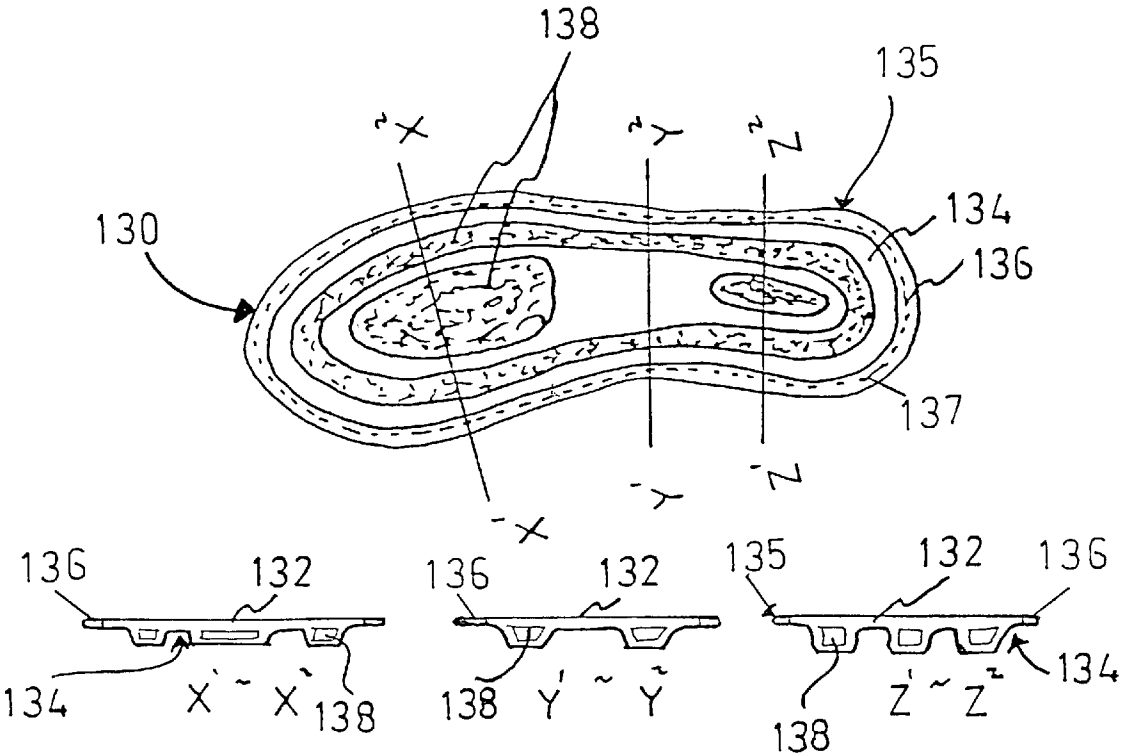
FIGS. 15A–15D are different views of a third variation of the preferred embodiment.

FIG. 15A shows stretchsole 130 having lower surface 134, perimeter edge 135, stretch layer binding tape 136 affixed to perimeter edge 135 via traditional stitching 137. In this format, the elastomeric material of stretchsole 130 comprises rubber or another type of moldable elastomer that can be prepared as various bulges and channels to provide a series of ambient or pressurized air chambers 138 in alternative shapes and sizes located on lower surface 134 of stretchsole 130 proper under direct pressure points in correlation to the human foot (i.e., under the heel and/or under the fore foot). Ambient or pressurized air chambers 138 are seen in cross-sectional views along three different axes, $X^1$-$X^2$, $Y^1$-$Y^2$, and $Z^1$-$Z^2$ respectively. These cross-sectional views are illustrated by FIGS. 15B, 15C, and 15D respectively.

As shown by FIG. 15 as a whole, ambient or pressurized air chambers 138 situated on lower surface 134 of stretchsole 130 will help dampen the weight of the human foot and/or disperse the compression forces generated by the wearer even as stretchsole 130 deforms and protrudes into the spatial air zone provided by the cavity space of the midsole cavity unit in the assembled shoe. Stretchsole 130 will be manufactured typically using two sheets of moldable rubber or other moldable elastomeric matter. The first or top sheet of moldable elastomer would be entirely flat while the second or bottom sheet of moldable elastomer would be shaped to provide the three-dimensional air chambers and intervening channels. The two sheets of moldable elastomer would then be joined together permanently using conventional bonding techniques to create stretchsole 130 having three-dimensional bottom surface 134 comprising multiple ambient or pressurized air chambers 138. The primary value and added benefit of having multiple three-dimensional ambient or pressurized air chambers 138 located over lower surface 134 of the deformable stretchsole 130 is the capability to provide additional dampening control and weight dispersion means—if and when the elastomeric material comprising stretchsole 130 is in danger of becoming overly extended or exhaustively deformed due to the wearer's unexpectedly great weight or an unexpected high impact specific activity. All other components of the footwear article incorporating this variation and improvement of stretchsole are identical to those described previously herein for the preferred embodiment.

A FOURTH VARIATION OF THE PREFERRED EMBODIMENT

Figure 16:
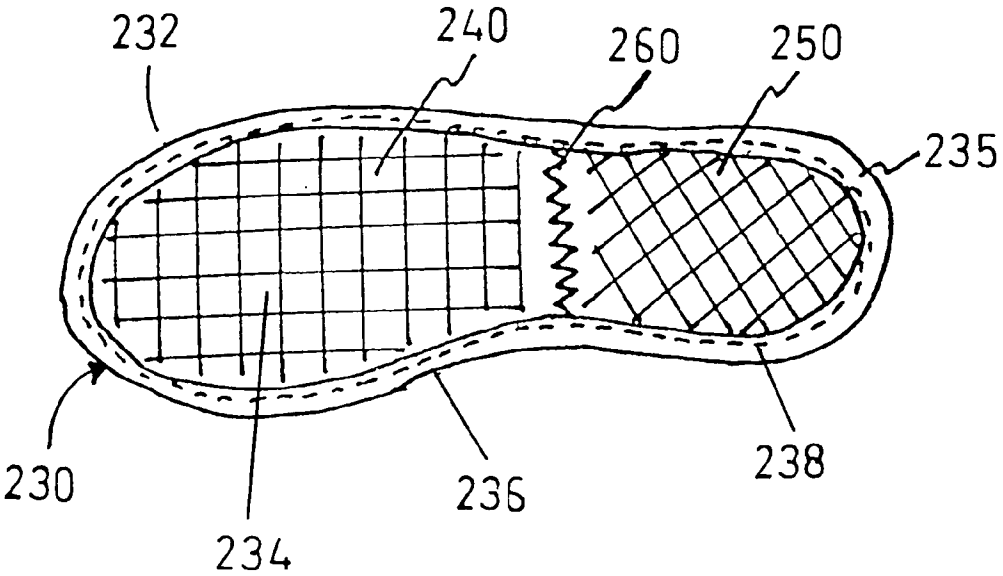
FIG. 16 is a view of a fourth variation of the preferred embodiment.

Another variation of the preferred format previously (illustrated herein by FIGS. 1–11 respectively) is shown by FIG. 16. As seen therein, modified stretchsole 230 is illustrated which has upper surface 232, lower surface 234, and perimeter edge 235. In this variation, however, the elastomeric material comprising stretchsole 230 is formed in two parts, forepiece 240 and heelpiece 250. The dimensions and configuration of forepiece 240 conform to the front of the typical shoe and provides adequate space for the toes and bridge of the foot, whereas heelpiece 250 conforms dimensionally to the heel of the foot in typical fashion. Forepiece 240 and heelpiece 250 are joined by and along common seam 260 created by stitching and/or adhesion in a conventionally known manner. When these two parts are joined together, they form a structurally integrated stretchsole 230, which is then affixed to encompassing perimeter edge 235 of upper shoe portion 22 to form a discrete elastic end closure in the manner previously described herein.

For purposes of attaching the two-part stretchsole 230, binding tape 236 is applied along lower surface 234 along perimeter edge 235; and tape 236 is subsequently traditionally stitched 238 directly to the elastomeric material comprising integrated stretchsole 230. This manner of juncture provides the reinforcement capability and functional strength for integrated stretchsole 230 to serve as an elastic end enclosure for upper assembly 20 in the assembled shoe 2 as described previously herein.

The major value of the two-part stretchsole 230 illustrated by FIG. 16 lies in the fact that forepiece 230 can be formed of a different elastomeric material than heel piece 250, thereby providing different elongation (or stretch) ratios in the front of shoe 2 in comparison to the back. This variation and difference in elongation ratios within different parts of a single planar stretchsole will allow a person to purchase a particular type of footwear for a specified activity (such as a tennis shoe) where a greater degree of deformity and stretch in the forefoot area of the shoe is highly desirable and where there is less deformity and stretch within the heel portion of the shoe. This capacity to provide dual elongation ratios within a single manufactured stretchsole is desirably used for those sports activities where such stretch and elongation differences are particularly wanted.

AN ALTERNATIVE EMBODIMENT

Figures 17A, 17B, 17C:
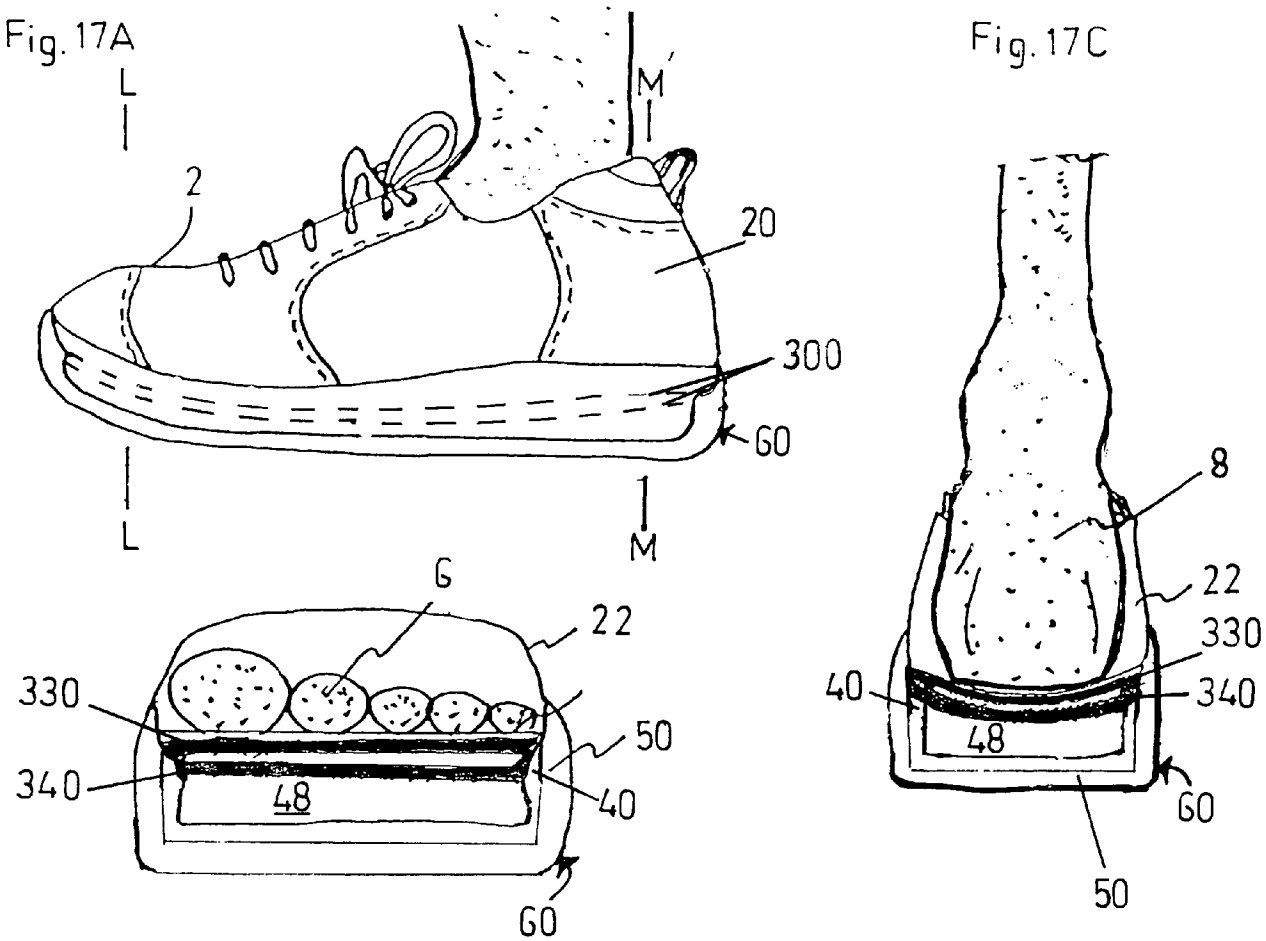
FIGS. 17A–17C are different views of a first alternative embodiment of the present invention.

An alternative embodiment of the present invention is illustrated by FIGS. 17A, 17B, and 17C respectively. This alternative embodiment conforms substantially to the preferred format described previously herein and illustrated by FIGS. 1–11 respectively, except for the mode of construction for the elastic stretchsole which is joined as a planar layer to the encompassing perimeter edge of the upper shoe portion and forms a discrete elastic end closure. This alternative embodiment is illustrated by FIG. 17A as an elevated side view of assembled shoe 2 worn on the human foot; by FIG. 17B as a transverse cross-sectional view along the axis LL' and showing the forefoot area; and by FIG. 17C which shows a transverse cross section view along the axis MM' and shows the heel area of the footwear.

As seen within FIG. 17A assembled shoe 2 comprises insole 10, upper assembly 20, and outsole unit 60—all as previously described herein; but now includes an improvement and variation in the structure of the stretchsole. As illustrated by FIGS. 17B and 17C respectively, unified stretchsole laminate 300 is shown which comprises two individual and distinct planar sheets: primary stretchsole sheet 330 and secondary stretchsole sheet 340. It is intended that each stretchsole sheet 330, 340 will be an individual planar layer formed of elastomeric material; that primary stretchsole sheet 330 will lie over and cover secondary stretchsole sheet 340; and that the two planar sheets 330, 340 will be stitched and/or adhered to each other to form unified stretchsole laminate 300. It is also expected that unified stretchsole laminate 300 will receive the binding tape reinforcement along its perimeter edge; and that primary stretchsole sheet 330 and secondary stretchsole sheet 340 will be traditionally stitched together to form a single elastic laminate which then will be joined to upper shoe portion 22 to form a discrete elastic end closure for upper assembly 20.

The added benefit of the unified stretchsole laminate 300 lies in its ability to use primary stretchsole sheet 330 which will have a higher elongation ratio (more deformation and stretch capacity) in the choice of elastomeric material utilized in comparison to secondary stretchsole sheet 340, which serves as bottom layer and which will be composed of an elastomeric material having a lower elongation ratio (less capacity to stretch and deform). Unified stretchsole laminate 300 is shown in both the forefoot and the heel areas of the footwear by FIGS. 17B and 17C respectively.

Because of the dual lamina stretchsole format involving both primary and secondary planar elastic sheets in combination, it is expected that during the normal gait cycle of walking, the wearer of this construct will primarily use only the top or primary stretchsole sheet 330. The rationale for this expectation is that because the elongation of the elastomeric material constituting primary stretchsole sheet 330 will not reach its maximum stretch capability while deforming. However, if the wearer of this constructed footwear uses this shoe for a more strenuous activity such as jogging (with the resulting higher weight impact upon the wearer's feet), secondary stretchsole sheet 340 will then serve to limit the elasticity and stretching capacity of the attached primary stretchsole sheet 330—due to its placement immediately beneath the primary layer. This arrangement will also provide a higher durometer capacity and therefore less stretch and deformity for the entire unified stretchsole laminate 300 as an integrated entity. Also, because there are two planar sheets of elastomeric material serving in combination to govern the deformation and expansion of the stretchsole as a whole, a dampening effect is created because the top elastic sheet (the primary stretchsole) is controlled and not permitted to "bottom out" by the more limited elastic characteristics and properties of the secondary stretchsole, especially during the higher impact activities. This multi-sheet construction and format providing a single integrated stretchsole laminate 300 with varying deformation and elastic attributes is a highly desirable advantage and major benefit in controlling the degree of foot cushioning and shock absorption for the wearer.

A SECOND ALTERNATIVE EMBODIMENT

Figure 18:
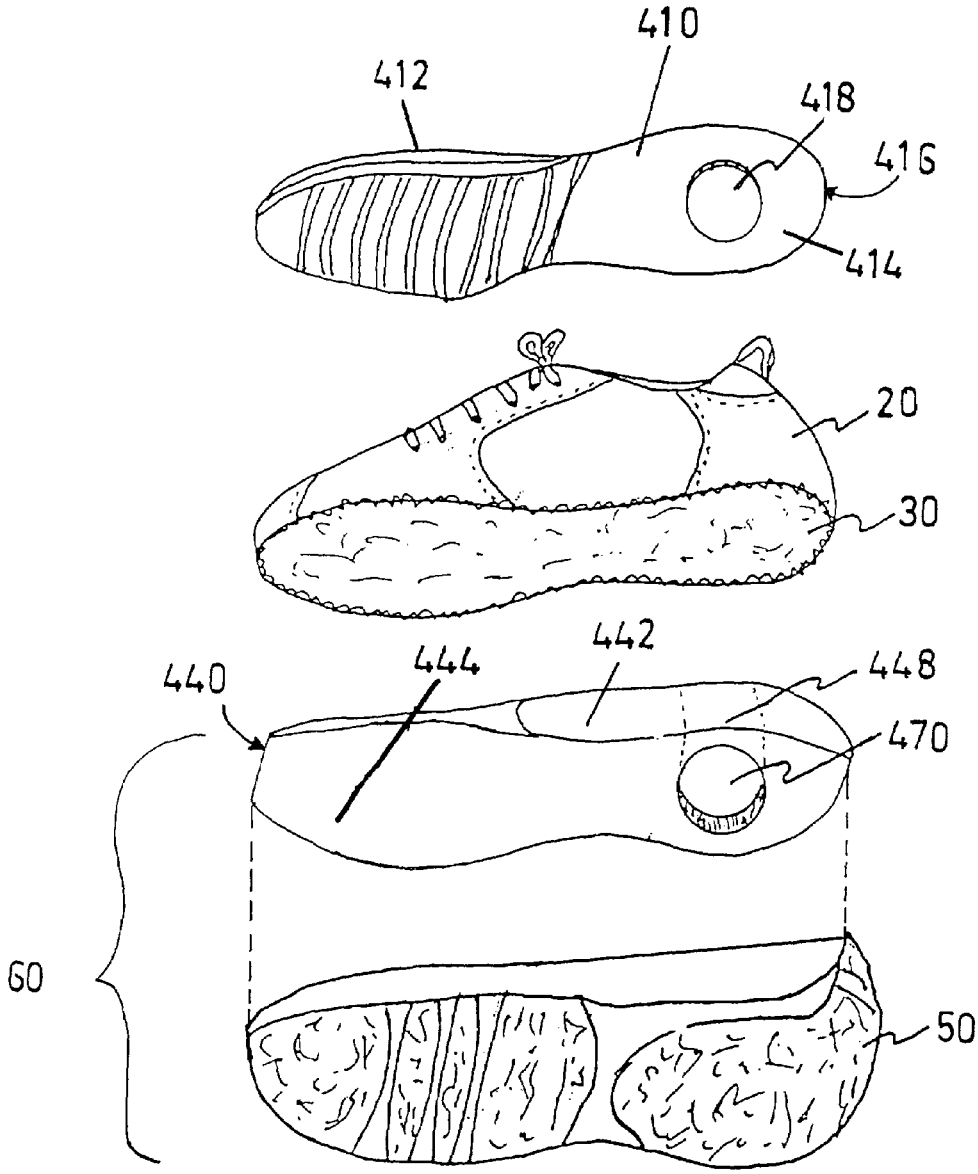
FIG. 18 is an exploded view of the component parts comprising a second alternative embodiment of the present invention.
Figure 19:
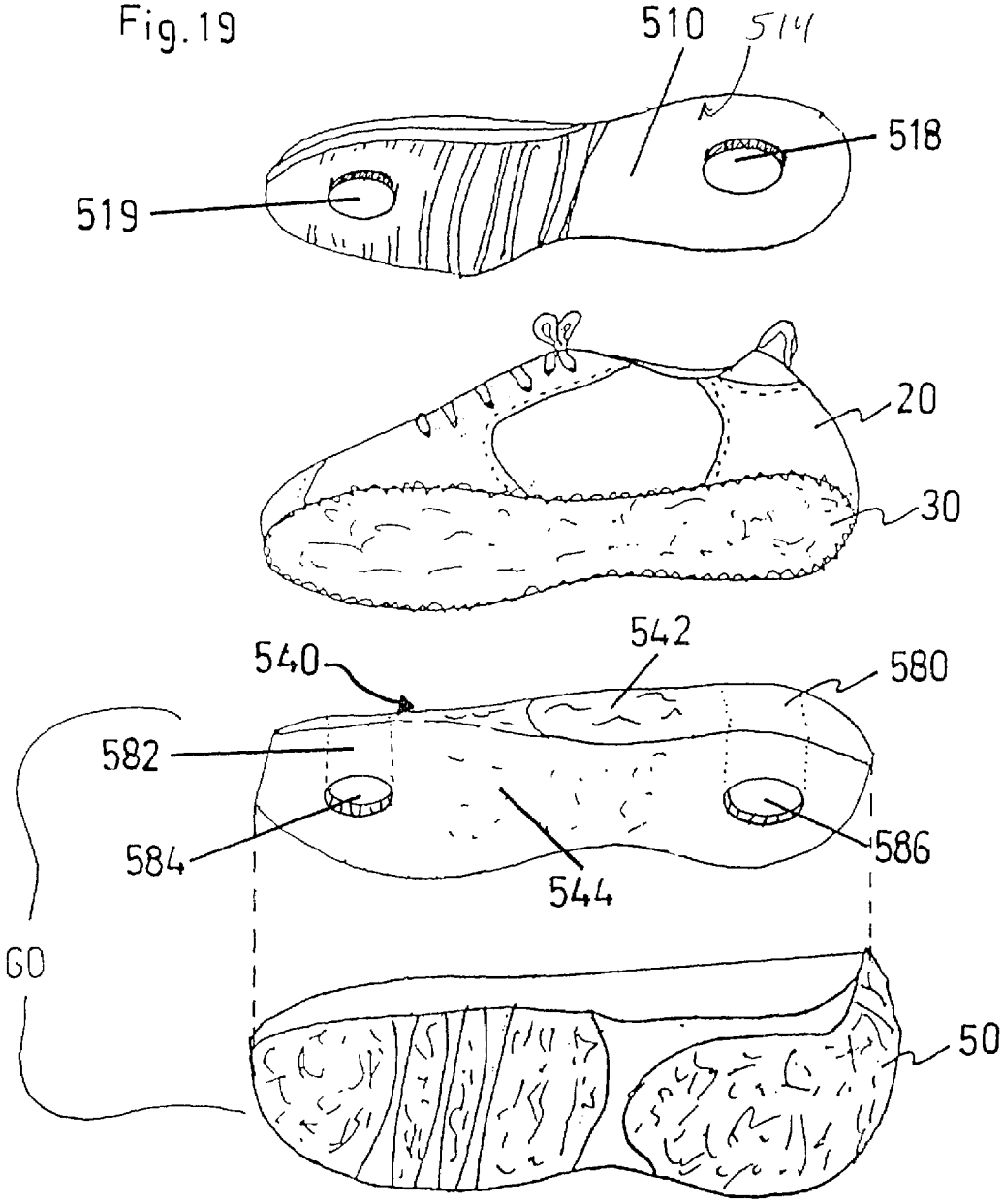
FIG. 19 is an exploded view of a desirable variation in the second alternative embodiment of FIG. 18.

A second alternative format for the present invention is illustrated by FIGS. 18 and 19 respectively. The essential component parts of the footwear construction are very similar to the preferred embodiment previously described herein and illustrated by FIGS. 1–11 respectively. This second alternative embodiment and construction, however, presents two unusual and valuable differences: First, there is a meaningful change in median cavity zone 40 of outsole unit 60 in that the preformed and pre-positioned median cavity 48 now occupies only a limited portion of the overall dimensions and total volume presented by outsole unit 60 as a whole. Second, there is a major alteration and modification to insole 10 employed within fully assembled shoe 2 These substantive differences are illustrated in detail by FIG. 18.

As shown by the exploded view of FIG. 18, modified insole 410 comprises top surface 412, bottom surface 414 and perimeter edge 416. In addition, however, located in the heel area of bottom surface 414 is a three-dimensional protrusion 418, shown for clarity as being of circular configuration. Three-dimensional protrusion 418 will serve to impact and deform stretchsole 30 of upper assembly 20 more severely within the heel area of the shoe, especially when the wearer's foot strikes the ground.

In addition and again for purposes of clarity only, the exploded view of FIG. 18 provides an illustration in which outsole unit 60 as a whole has been artificially and intentionally separated into a distinct modified cavity zone 440 and a distinct outer shell zone 50 (as described previously herein). In reality, modified median cavity zone 440 is housed and remains contained within the interior of outsole unit 60. When constructing the footwear, therefore, outsole unit 60 as a whole is employed as a single integrated component.

FIG. 18 shows that modified median cavity zone 440 (housed within outsole unit 60) is composed of a sidewall 442, solid bottom portion 444, preformed cavity chamber 448 of restricted dimensions, and pre-positioned median cavity 470 of limited volume. The dimensions and spatial volume of preformed cavity chamber 448 are size-restricted in comparison to that seen in the preferred embodiment illustrated herein by FIGS. 1–11; and the volume-limited median cavity 470 resulting thereby is pre-positioned to lie only within the heel area of modified median cavity zone 440.

This alternative format of the present invention thus creates a restricted volume of ambient air within cavity chamber 448 lying within the heel area of modified cavity zone 440 and provides median cavity 470 of limited volume which is intended to receive protrusion 418 of insole 410 and the deformed heel area of stretchsole 30 in order to cushion the compression forces generated thereon by the wearer's foot.

In addition, as seen in FIG. 18, protrusion 418 in the heel area of insole 410 lies adjacent to and is aligned with stretchsole 30 (which lies affixed to encompassing perimeter edge 21 of upper shoe portion 22 and provides a discrete elastic end closure for upper assembly 20); and is also aligned with size-restricted cavity chamber 448 of modified median cavity zone 440—such that when the heel of the foot strikes the ground, protrusion 418 will be forced directly upon the elastomeric material of stretchsole 30 and extend into volume-limited median cavity 470 for cushioning purposes. This alternative embodiment and format will operate to cushion the person's foot; to act as a shock absorbing system in a similar manner to that described previously herein; and will allow the "trampoline effect" of the stretchsole to occur, but in a mode focused and restricted to the heel area and the volume-limited median cavity 470.

As a manufacturing detail, it is expected that protrusion 418 will be of a slightly smaller size and configuration than the dimensions of median cavity 470 provided by the cavity chamber 448 in modified median cavity zone 440 of outsole unit 60. This slight size difference will allow protrusion 418 deforming the elastomeric material of stretchsole 30 to push into the more limited volume provided by the smaller dimensions of cavity chamber 448.

Another variation of this same innovative format is illustrated by FIG. 19. Here again for purposes of clarity only, the exploded view of FIG. 19 illustrates outsole unit 60 which has been artificially and intentionally separated into a distinct modified cavity zone 540 and a distinct outer shell zone 50 (as described previously herein). In reality, modified median cavity zone 540 is housed and remains contained within the interior of outsole unit 60. When constructing the footwear, therefore, outsole unit 60 as a whole is employed as a single integrated component.

As seen in FIG. 19, insole 510 has two three-dimensional protrusions, forefoot protrusion 519 and heel protrusion 518 located on the bottom surface. Similarly, modified median cavity zone 540 (housed with the interior of outsole unit 60) is shown which comprises sidewall 542, solid center portion 544, two distinct cavity chambers 580 and 582, and two distinct median cavities 584, 586 respectively. The substantive center portion 544 includes a solid matter shank area which acts as a stabilizer for median cavity zone 540 as a whole. In all other respects, the component parts and assembly of assembled shoe 2 is as described previously for the preferred embodiment illustrated by FIGS. 1–11 respectively.

It is also intended and expected for the embodiment illustrated by FIG. 19 that the volumetric dimensions of the two cavity chambers 580, 582 will be slightly larger in overall size than the dimensions of forefoot protrusion 519 and heel protrusion 518 positioned on the bottom of insole 510. This variation and alternative construction will allow the individual's weight to be cushioned and supported both when the forefoot strikes the ground and when the heel of the foot is impacted to provide a better cushioning and shock absorbing system at both ends of the shoe.

A THIRD ALTERNATIVE EMBODIMENT

Figure 20:
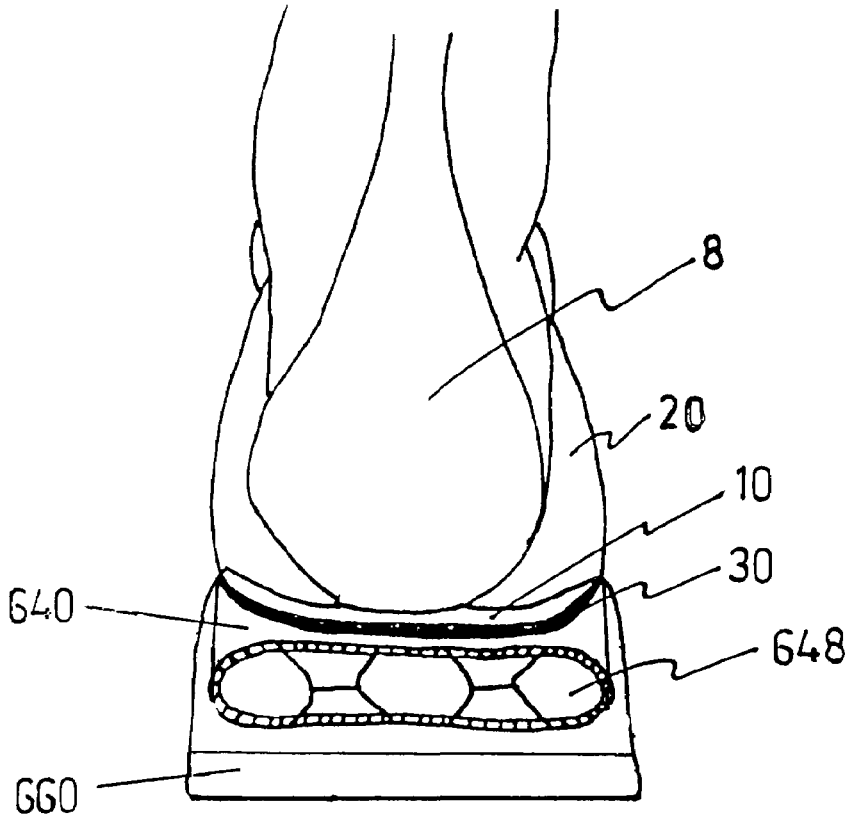
FIG. 20 is a transverse cross-sectional view of a third alternative embodiment for the unique foot cushioning construct and shock absorbing system within an article of footwear.

A third alternative embodiment of the present invention providing a foot cushioning construct and a shock absorbing system is illustrated by FIG. 20 as a transverse cross-sectional view of the heel area in an assembled shoe. This third alternative embodiment typically employs insole 10, upper assembly 20 including stretchsole 30, a traditionally known midsole 640, and a conventional outsole 660. In this alternative embodiment, stretchsole 30 is as previously described herein; and forms a discrete elastic end closure for upper assembly 20. Stretchsole 30 is thus the unique and essential element which acts in concert with traditional midsole 640 and conventional outsole 660 in this construction.

In this embodiment and construction, a commonly known capsule 648 lies positioned within the substance of traditional midsole 640 as the means for foot cushioning; and both traditional midsole 640 and capsule 648 are housed and contained by conventional outsole 660. These capsules include such commercially used forms such as the Nike airbag located within the heel of a polyurethane midsole. As most of these conventional capsule technologies are being used today, the actual cushioning effect of a sealed capsule, or an enclosed airbag, or cushioning technology lying within a traditional midsole is not being fully utilized owing to the common use of a non-stretch lasting material separating the foot from the cushioning technology.

In comparison, the third alternative construction shown in FIG. 20 uses the conventional sealed air capsules, airbags, air containment means, and other existing cushioning technology (including gels and highly deformable and reformable elastic material) positioned within the substantive thickness of the traditional midsole in combination with the unique elastic stretchsole for enhanced cushioning and support the foot during impact. The elastic stretchsole will deform and rebound repeatedly on demand in response to the compression forces generated thereon by a person's foot; and utilize the conventional capsules and bags lying within the traditional midsole for support. The use and value of the elastic stretchsole as a deformable planar layer (and upper end closure affixed to upper shoe portion) will enhance and increase the degree of foot cushioning and support over that provided by the conventionally known airbag or cushioning technology constructions alone.

The present invention is not to be limited in form nor restricted in scope except by the claims appended hereto.

We claim:

1. In a constructed article of footwear to be worn by a human person which includes at least a shoe upper having a perimeter edge for housing the human foot and an outsole joined to the shoe upper which serves as an exterior bottom for the article of footwear, the improvement in foot cushioning comprising:

a continuous, uniform, planar elastic stretchsole which is lasted entirely about the perimeter edge of and forms an elastic end closure for the shoe upper, said lasted elastic stretchsole being able to deform and rebound repeatedly on-demand in response to the compression forces generated thereon by a person's foot, and at least one median cavity housed within the outsole of the footwear article and positioned adjacent to said lasted elastic stretchsole of the shoe upper, said median cavity being capable of receiving at least a part of said deformed elastic stretchsole.

2. In a constructed article of footwear to be worn by a person which includes at least a shoe upper having a perimeter edge for housing the human foot and an outsole portion joined to the shoe upper which serves as an exterior bottom for the article of footwear, the improvement in foot cushioning comprising:

a continuous, uniform, planar elastic stretchsole which is lasted entirely about the perimeter edge of and forms an elastic end closure for the upper shoe, said lasted elastic stretchsole being able to deform and rebound repeatedly in response to the compression forces generated thereon by a person's foot; and at least one preformed cavity chamber of determinable dimensions and configuration housed within the outsole of the footwear article, said performed cavity chamber being positioned adjacent to said lasted elastic stretchsole of the shoe upper and presenting not less than one median cavity able to receive at least a part of a deformed elastic stretchsole.

3. The improved article of footwear as recited in claim 2 wherein a single performed cavity chamber is housed within the outsole.

4. The improved article of footwear as recited in claim 2 wherein multiple performed cavity chambers are housed within the outsole.

5. The improved article of footwear as recited in claim 2 wherein said performed cavity chamber is formed of elastomeric material.

6. The improved article of footwear as recited in claim 1 or further comprising an insole lying adjacent to said elastic stretchsole within the shoe upper.

7. The improved article of footwear as recited in claim 1 or 2 wherein said elastic stretchsole is formed of a resilient material.

8. The improved article of footwear as recited in claim 1 or 2 wherein said elastic stretchsole is a material selected from the group consisting of elastic webbing, thermal plastic resin, latex, rubber, nylon, polyurethane, and elastomers comprised in part of polyurethane.

9. The improved article of footwear as recited in claim 1 or 2 wherein said elastic stretchsole is lasted to the perimeter edge of the shoe upper shoe by sewing means.

10. The improved article of footwear as recited in claim 1 or 2 wherein said elastic stretchsole is lasted to the perimeter edge of the shoe upper shoe portion by adhesive means.

11. The improved article of footwear as recited in claim 1 or 2 wherein said elastic stretchsole can be stretched in a manner selected from the group consisting of a one-way stretch mode, a two-way stretch mode, and a multidirectional stretch mode.

12. A foot cushioning system for use in a constructed article of footwear which includes a shoe upper having a perimeter edge for housing the human foot and an outsole which is joined to the shoe upper and serves as an exterior bottom for the article of footwear, said foot cushioning system comprising:

a continuous elastic stretchsole configured as at least one planar sheet and lasted entirely about the perimeter edge of the shoe upper as an end closure, said lasted elastic stretchsole end closure deforming and then rebounding into planar layer form in response to the compression forces generated thereon by a person's foot; and at least one median cavity existing within a performed cavity chamber which is housed within the outsole of the footwear article, wherein said median cavity and performed cavity chamber lie adjacent to said lasted stretchsole end closure of the shoe upper, and whereby said median cavity is able to receive a deformed stretchsole end closure and to enable said stretchsole to cushion a person's foot from the effects of compression forces.

13. The cushioning system as recited in claim 12 wherein said median cavity is further provided with cushioning means such that at least some of the compression forces from a deformed stretchsole end closure are absorbed by said cushioning means.

14. The cushioning system as recited in claim 12 wherein said compression forces are subsequently transferred to and released through the shoe upper.

15. The cushioning system as recited in claim 12 wherein an increased flow of air is circulated within the shoe upper and outsole of the footwear by means of deformation and reformation of said stretchsole acting in the manner of a bellows.

16. The cushioning system as recited in claim 13 wherein said cushioning system is selected from the group consisting of sealed air capsules, airbags, air containment means, gel capsules, and highly deformable and reformable elastic materials.

17. The cushioning system as recited in claim 13 wherein said cushioning means are disposed throughout the length and breadth of said median cavity.

18. The cushioning system as recited in claim 13 wherein said cushioning means are selectively disposed at pressure points under said foot.

19. A foot cushioning system for use in constructed article of footwear which includes a shoe upper having a perimeter edge for housing the human foot and an outsole which is joined to the shoe upper and serves as an exterior bottom for the article of footwear, said foot cushioning system comprising:

a continuous, uniform elastic stretchsole configured as at least one planar sheet and lasted entirely about the perimeter edge of the shoe upper as and end closure, said lasted elastic stretchsole end closure deforming and then rebounding into planar layer form in response the compression forces generated thereon by a person's foot by; and a cushioning midsole disposed under said shoe upper and said elastic stretchsole and at least partially within said outsole, said midsole being capable of deforming and rebounding in sympathy with said elastic stretchsole such that said compression forces are at least partially absorbed by said midsole.

20. The cushioning system as recited in claim 19 wherein said cushioning midsole comprises cushioning means selected from the group consisting of sealed air capsules, airbags, air containment means, gel capsules, and highly deformable and reformable elastic materials.

21. The cushioning system as recited in claim 19 wherein said cushioning means are disposed throughout the length and breadth of said median cavity.

22. The cushioning system as recited in claim 19 wherein said cushioning means are selectively disposed at pressure points under said foot.

23. The cushioning system as recited in claims 1, 2, 12 or 19 wherein said elastic stretchsole has joined thereto a dampening element composed of non-stretch material, said dampening element having smaller dimensions than said stretchsole and being disposed such that it does not engage said lasted perimeter edge, said dampening element being capable of reducing the amount of deformation of said stretchsole in response to said compression forces.

24. The cushioning system as recited in claims 1, 2, 12 or 19 wherein said elastic stretchsole has an upper surface and a lower surface, said lower surface being provided with a plurality of air chambers.

25. The cushioning system as recited in claim 24 wherein said air chambers are ambient.

26. The cushioning system as recited in claim 24 wherein said air chambers are pressurized.

27. The cushioning system as recited in claim 24 wherein said air chambers are selectively disposed under the pressure points of said foot.

28. The cushioning system as recited in claims 1, 2, 12 or 19 wherein said elastic stretchsole is constructed of more than one planar element.

29. The cushioning system as recited in claim 28 wherein said more than one planar elements have different elongation ratios.

30. The cushioning system as recited in claim 28 wherein each of said more than one planar elements underlie only a portion of said foot.

31. The cushioning system as recited in claim 28 wherein one of said more than one planar elements underlies the other, such that each of said more than one planar elements underlies the entirety of said foot.

32. The cushioning system as recited in claims 1, 2, 12 or 19, further comprising an insole having an upper surface and a lower surface and being disposed above said stretchsole such that said insole is in direct contact with said foot, said insole being provided with at least one protrusion selectively disposed on said lower surface under at least one pressure point of said foot, such that when said foot generates compression forces on said insole, said at least one protrusion engages said stretchsole and said stretchsole is selectively deformed into said median cavity, thereby enhancing the cushioning effect on said foot.

* * * * *